US007690167B2

(12) United States Patent
Antonic

(10) Patent No.: US 7,690,167 B2
(45) Date of Patent: Apr. 6, 2010

(54) STRUCTURAL SUPPORT FRAMING ASSEMBLY

(76) Inventor: James P. Antonic, 9111 Southmont Cove, #406, Ft. Myers, FL (US) 33908

( * ) Notice: Subject to any disclaimer, the term of this patent is extended or adjusted under 35 U.S.C. 154(b) by 601 days.

(21) Appl. No.: 11/116,769

(22) Filed: Apr. 28, 2005

(65) Prior Publication Data

US 2006/0254167 A1 Nov. 16, 2006

(51) Int. Cl.
*E04C 2/34* (2006.01)

(52) U.S. Cl. ..... 52/481.1; 52/296; 52/489.1

(58) Field of Classification Search ..... 52/296, 52/298, 292, 151, 481.1, 481.2, 482, 489.1, 52/489.2, 150, 152; 256/65.14; 403/230, 403/231, 298

See application file for complete search history.

(56) References Cited

U.S. PATENT DOCUMENTS 1,958,124 A 5/1934 Bemis
1,959,135 A * 5/1934 Miller ..... 52/376
2,363,164 A 11/1944 Waller
2,380,834 A 7/1945 Goldman
2,731,116 A 1/1956 Allison
3,184,013 A 5/1965 Pavlocka
3,310,926 A 3/1967 Brandreth
3,332,188 A * 7/1967 Schaefer ..... 52/349
3,363,371 A 1/1968 Villalobos
3,498,014 A 3/1970 Fergen
3,533,205 A 10/1970 Pestel et al.
3,623,290 A 11/1971 Downing, Jr.
3,630,474 A * 12/1971 Minor ..... 52/98
3,821,868 A 7/1974 Edwards
4,107,893 A 8/1978 Rensch
4,124,186 A 11/1978 Call, Sr.
4,199,908 A * 4/1980 Teeters ..... 52/295
D256,663 S 9/1980 Gilb
4,235,054 A 11/1980 Cable
4,261,144 A 4/1981 Rizzo
4,272,930 A 6/1981 Foster
4,285,184 A 8/1981 Turner, Jr.
4,324,082 A 4/1982 Rutkowski et al.
4,353,192 A 10/1982 Pearson et al.
D268,288 S 3/1983 Cowdroy
4,542,614 A 9/1985 Malachowski
D283,352 S 4/1986 Bancroft
D286,199 S 10/1986 Bancroft
4,630,547 A 12/1986 Przybylinski et al.
4,660,339 A 4/1987 Paz
4,714,372 A 12/1987 Commins
4,744,192 A 5/1988 Commins
D297,502 S 9/1988 Archambeau
4,812,075 A 3/1989 Lavin, Sr.

(Continued)

OTHER PUBLICATIONS

PCT Written Opinion (PCT/US06/39754), Sep. 25, 2007, 11 pages total.

(Continued)

*Primary Examiner*—Richard E Chilcot, Jr.
*Assistant Examiner*—Chi Q Nguyen
(74) *Attorney, Agent, or Firm*—Laura Barrow

(57) ABSTRACT

Novel structural support framing assemblies and component thereof are described herein for use in residential, commercial, and industrial building construction. Preferred embodiments of the inventive framing assembly include the employment of a variety of structural studs and stud mounts, the studs preferably fabricated of a composite material.

26 Claims, 21 Drawing Sheets

U.S. PATENT DOCUMENTS

D318,130 S 7/1991 Abbestam et al.
5,069,263 A 12/1991 Edwards
5,070,667 A 12/1991 Schulte
5,081,813 A 1/1992 White
5,260,525 A 11/1993 Morse
D342,662 S 12/1993 Lavin, Sr.
D349,166 S 7/1994 Beard, Jr.
5,390,460 A 2/1995 Llorens
5,394,665 A * 3/1995 Johnson ..... 52/241
5,403,062 A 4/1995 Sjostedt et al.
D358,755 S 5/1995 Davis
5,423,156 A 6/1995 Nellessen, Jr.
D363,997 S 11/1995 Nomura
D364,331 S 11/1995 Leek
D371,208 S 6/1996 De Zen
D371,505 S 7/1996 Young
5,561,955 A 10/1996 Frobosilo et al.
D377,598 S 1/1997 Beard, Jr.
D378,422 S 3/1997 Howe
5,611,173 A 3/1997 Headrick et al.
5,644,888 A 7/1997 Johnson
D384,169 S 9/1997 Leonelli
5,678,797 A 10/1997 Gogan
5,706,620 A 1/1998 De Zen
5,706,626 A 1/1998 Mueller
5,735,090 A 4/1998 Papke
5,755,064 A 5/1998 Meyer et al.
5,758,466 A 6/1998 Tucker
5,794,746 A 8/1998 Ketonen et al.
5,797,233 A 8/1998 Hascall
5,799,454 A 9/1998 Anderson
5,802,798 A 9/1998 Martens
D400,080 S 10/1998 Beard, Jr.
5,848,512 A 12/1998 Conn
D407,828 S 4/1999 Hart
5,927,039 A 7/1999 De Boer
5,930,968 A 8/1999 Pullam
5,950,385 A 9/1999 Herren
6,003,279 A 12/1999 Schneider
6,023,898 A * 2/2000 Josey ..... 52/309.5
D423,690 S 4/2000 Grosfillex
6,067,769 A 5/2000 Hardy
6,092,340 A 7/2000 Simmons
D432,671 S 10/2000 Grosfillex
6,216,395 B1 4/2001 Kelly
6,223,494 B1 5/2001 Bright
D443,810 S 6/2001 Ausilio
6,260,601 B1 7/2001 Thomas
D446,870 S 8/2001 Gardner
6,272,796 B1 8/2001 Metzler
6,276,094 B1 8/2001 Hays
D447,574 S 9/2001 Fening
6,314,704 B1 11/2001 Bryant
D452,016 S 12/2001 Hall
6,336,298 B1 1/2002 Chou
6,341,458 B1 1/2002 Burt
6,427,403 B1 8/2002 Tambakis
6,438,903 B1 8/2002 Weiss
D465,586 S 11/2002 Krieger
6,519,911 B1 2/2003 Sawada
D473,123 S 4/2003 Anderson
D473,955 S 4/2003 Gregori
6,553,731 B2 4/2003 Hsueh
D474,286 S 5/2003 Gregori
D474,549 S 5/2003 Krieger
6,581,337 B1 6/2003 Skov et al.
6,655,096 B1 12/2003 Pryor
6,684,573 B2 2/2004 Heath et al.
6,739,562 B2 5/2004 Rice
6,754,999 B1 6/2004 Urbanczyk
D492,889 S 7/2004 Craine
6,789,358 B2 9/2004 Procton et al.
6,802,169 B2 10/2004 Simmons
D500,667 S 1/2005 Murphy et al.
6,837,012 B2 1/2005 Scherrer et al.
6,837,019 B2 1/2005 Collie
D511,086 S 11/2005 Craine
D511,217 S 11/2005 Bullock et al.
D523,565 S 6/2006 Antonic
D523,735 S 6/2006 Craine
7,086,204 B2 8/2006 Salzer
D537,537 S 2/2007 Antonic
7,178,305 B2 2/2007 Petrova
D540,479 S 4/2007 Antonic
7,207,148 B2 4/2007 Surowiecki
D544,784 S 6/2007 Antonic
D549,851 S 8/2007 Antonic
D552,947 S 10/2007 Ewasiuk
D553,261 S 10/2007 Antonic
D553,761 S 10/2007 Antonic
D554,273 S 10/2007 Antonic
D554,773 S 11/2007 Antonic
D554,774 S 11/2007 Antonic
D554,775 S 11/2007 Antonic
D555,259 S 11/2007 Antonic
D555,467 S 11/2007 Pecoraro
D561,353 S 2/2008 Antonic
D561,354 S 2/2008 Antonic
D561,355 S 2/2008 Antonic
7,334,377 B2 2/2008 Dubensky et al.
D574,518 S 8/2008 Antonic
D574,697 S 8/2008 Green
D581,253 S 11/2008 Antonic
D588,440 S 3/2009 Antonic
2002/0066245 A1 6/2002 Pryor
2002/0069600 A1 6/2002 Bryant
2002/0092245 A1 7/2002 Floyd et al.
2002/0148178 A1 10/2002 Farag
2003/0029124 A1 2/2003 Wise
2003/0089066 A1 5/2003 Nelson
2003/0217521 A1 11/2003 Richardson et al.
2004/0107653 A1 6/2004 Collie
2004/0163355 A1 8/2004 Collie
2004/0227039 A1 11/2004 Real et al.
2005/0011157 A1 1/2005 Lutz et al.
2006/0026924 A1 2/2006 Madsen
2006/0156660 A1 7/2006 Stateson
2006/0207209 A1 9/2006 Metroyanis et al.
2007/0094992 A1 5/2007 Antonic
2007/0193143 A1 8/2007 Antonic
2008/0236058 A1 10/2008 Antonic

OTHER PUBLICATIONS

U.S. Appl. No. 29/273,324, filed Mar. 2, 2007, Antonic.
PCT Search Report (relevant sections) for PCT/US07/03998 (Sep. 9, 2008) (12 pages).
PCT Written Opinion (PCT/US06/15656), Jul. 7, 2008, 10 pages total.
Office action (relevant pages) dated Nov. 24, 2008 for Applicant's pending U.S. Appl. No. 11/356,482 (Pub. No. 2007/1093143).
PCT International Search Report for PCT/US2007/26401—relevant pages (Date: Jun. 12, 2008) related to Applicant's pending application 2008/0236058.

* cited by examiner

STRUCTURAL SUPPORT FRAMING ASSEMBLY

SUMMARY OF THE INVENTION

The present invention is directed to an improved structural support framing assembly for use in residential, commercial, and industrial building construction. The inventive framing system is applicable to single story buildings as well as multi-story buildings.

In certain aspects, the inventive structural support framing system comprises (a) a plurality of stud mounts, each of the mounts having a base secured to a floor pad; (b) a plurality of studs, each of the studs having a top end and a bottom end, the bottom end having one or more edges engaged within one or two of the stud mounts; and (c) a plurality of fasteners for securing the studs to the stud mounts, at least one of the fasteners engaging one of the studs to one of the adjacent plates along any point along the stud, thereby allowing for height adjustment of the stud within the stud mount in order to accommodate any un-level areas of the floor pad. The stud mount further has at least two parallel plates integral with and perpendicular to the base, wherein adjacent plates form an elongated slot therebetween to engage only one of the bottom edges of the stud within the slot. Each of the plurality of stud mounts is secured to only one of the studs, wherein each of the plurality of studs, in combination with the stud mounts, are positioned parallel to one another and perpendicular to the floor pad to define, in combination with one another, an interior portion of the framing assembly. The plurality of studs may comprise a first set of corner posts and a second set of studs positioned between the corner posts.

An alternative stud mount design comprises a base configured for attachment to a floor pad and at least two adjacent parallel plates integral with and perpendicular to the base. However, in this embodiment, each of the parallel plates includes one or more slots penetrating therethrough, such that slots of adjacent plates are in registration with one another in order to engage therein the bottom edge of a structural stud. The stud mount further includes at least one fastener for securing a portion of the bottom end of the stud to the stud mount as well as at least one fastener for securing the base to the floor pad.

Exemplary structural studs comprise various configurations. For example, the corner posts each may have a hollow outer body defining an interior longitudinal channel, a portion of the outer body further including an indentation sufficiently large for receiving an outer edge of an interior wall sheet, the indentation being oriented toward the interior portion of the structural framing assembly. The internal longitudinal channel of the corner posts may also house at least one electrical or electronic transmission wire running therethrough. The studs comprising the second set of studs may include a stud having a substantially double-I shaped transverse cross-section, interior webs, and two exterior flanges perpendicular to the exterior flanges to define an inner longitudinal channel, each of the flanges suitable for engaging a wall sheet. The interior webs of the double-I stud comprise two of the bottom edges, each of the bottom edges engaged within one of the slots of the stud mount. The longitudinal channel of the double-I stud may also house at least one electrical or electronic transmission wire running therethrough Another stud configuration has a substantially single-I shaped transverse cross-section and further comprises two exterior flanges secured to a single web oriented perpendicular to the flanges, the exterior flanges suitable for engaging a wall sheet. The interior web comprises the bottom edge of the single-I stud, which is further engaged within the slot of the stud mount. Other stud configurations include a substantially rectangular (i.e. square and oblong) transverse cross section defining an inner longitudinal channel. In the rectangular stud designs, the longitudinal channel may also house at least one electrical or electronic transmission wire running therethrough Moreover, the rectangular studs may function as corner posts, as well.

The inventive framing assembly further includes various horizontal headers secured to the top end of adjacent studs to span a door opening or window opening located between the studs. One header embodiment is a single member having a double I-beam transverse cross section comprising upper and lower flanges secured to one another by a central elongated double I-beam member. The upper flange further comprise a pair of side walls and a pair of vertical flanges extending therefrom, whereby the small vertical flanges provide a foothold for workers standing upon the header during construction and the side walls of the upper flange provide a location for attachment of interior and exterior sheetings. A second header design comprises two adjacent elongated members, each having a double-I beam transverse cross section configuration with upper and lower flanges. The two adjacent elongated header members are further secured to one another by a C-channel member secured to the top flanges of the two adjacent elongated header members. The connecting member further comprises two side walls and preferably a pair of small vertical flanges extending from one of the side walls, whereby the flanges provide a foothold for workers standing upon the header during construction.

Other aspects of the present invention include one or more sill plates secured to a floor pad, wherein at least one of the sill plates is formed of a material, such as a thermoplastic composite material, penetrable by a nail fastener. When a sill plate is employed, at least one of the stud mounts is secured within a longitudinal recess of one of the sill plates. The longitudinal recess of the sill plate is defined by interior and exterior side walls and may include a shield projecting from the outer surface of the exterior side wall. The shield of the sill plate has a portion angled downward over an edge of the floor pad and functions as a drain for rainwater run-off as well as a protective barrier against subterranean termites and similar pests.

Other aspects of the inventive structural support framing assembly comprise an attachment strip secured to the interior body surfaces of adjacent studs. The attachment strip is formed of a composite material (preferably a thermoplastic composite material) that is penetrable by a nail fastener for engagement therein and used, for example, as a place where a chair rail may be secured to the interior walls of the building.

Other aspects of the present invention include the employment of one or more truss mounts for supporting a roof truss or rafter, the truss mount having a base secured onto a connecting member of the framing assembly and positioned in registration with the top end of one of the second set of studs. The truss mount further has a pair of parallel plates extending from, and perpendicular to, the truss mount base to define a recess therebetween between. The recess of the truss mount is configured to engage a portion of the roof truss or rafter.

The inventive structural framing assembly, as discussed above, may be applicable to multi-story buildings. Such assemblies include (a) a first plurality of stud mounts, each having a base secured to a first floor pad of a first story of the framing assembly; (b) a second plurality of inverted stud mounts, each having a base secured to a bottom surface of a second floor pad, the second floor pad oriented directly above and parallel to the first floor paid; (c) a first plurality of studs connecting the first and second floor pads, each of the studs having a top end and a bottom end, the bottom end having one or more edges engaged within one or two of the first plurality of stud mounts, and the top end having one or more edges engaged within one or two of the second plurality of stud mounts; (d) a third plurality of stud mounts, each having a base secured to a top surface of a second floor pad; and (e) a second plurality of studs, each of the studs having a top end and a bottom end, the bottom end having one or more edges engaged within one or two of the third plurality of stud mounts. Each of the stud mounts further has at least two parallel plates integral with and perpendicular to the base, wherein the bottom end or top end of the studs are engaged between parallel plates. The stud mounts may further include at least one hole communicating through the base for engaging a fastener, the fastener configured to secure the stud mounts to the first or second floor pads. A plurality of fasteners for securing the studs to the stud mounts are also included, at least one of the fasteners engaging one of the studs to one of the adjacent plates along any point along the stud, thereby allowing for height adjustment of the stud within the stud mount to accommodate any un-level areas of the first or second floor pads. In the multi-story embodiment, one or more of the second inverted stud mounts are positioned immediately subjacent to one of the third stud mounts, such that the bases of the second inverted stud mount and the third stud mount are in registration with one another. The second inverted stud mount and the third stud mount are further connected to one another by an elongated bolt communicating through the second floor pad and through the respective stud mount base holes of the second and third stud mounts. The stud mounts of the multi-story embodiment may also comprise at least two parallel plates, wherein each one of the adjacent plates includes one or more slots penetrating therethrough, such that slots of adjacent plates are in registration with one another in order to engage therein the bottom edge and top edge of one of the studs.

DETAILED DESCRIPTION OF THE EMBODIMENTS

Figure 1:
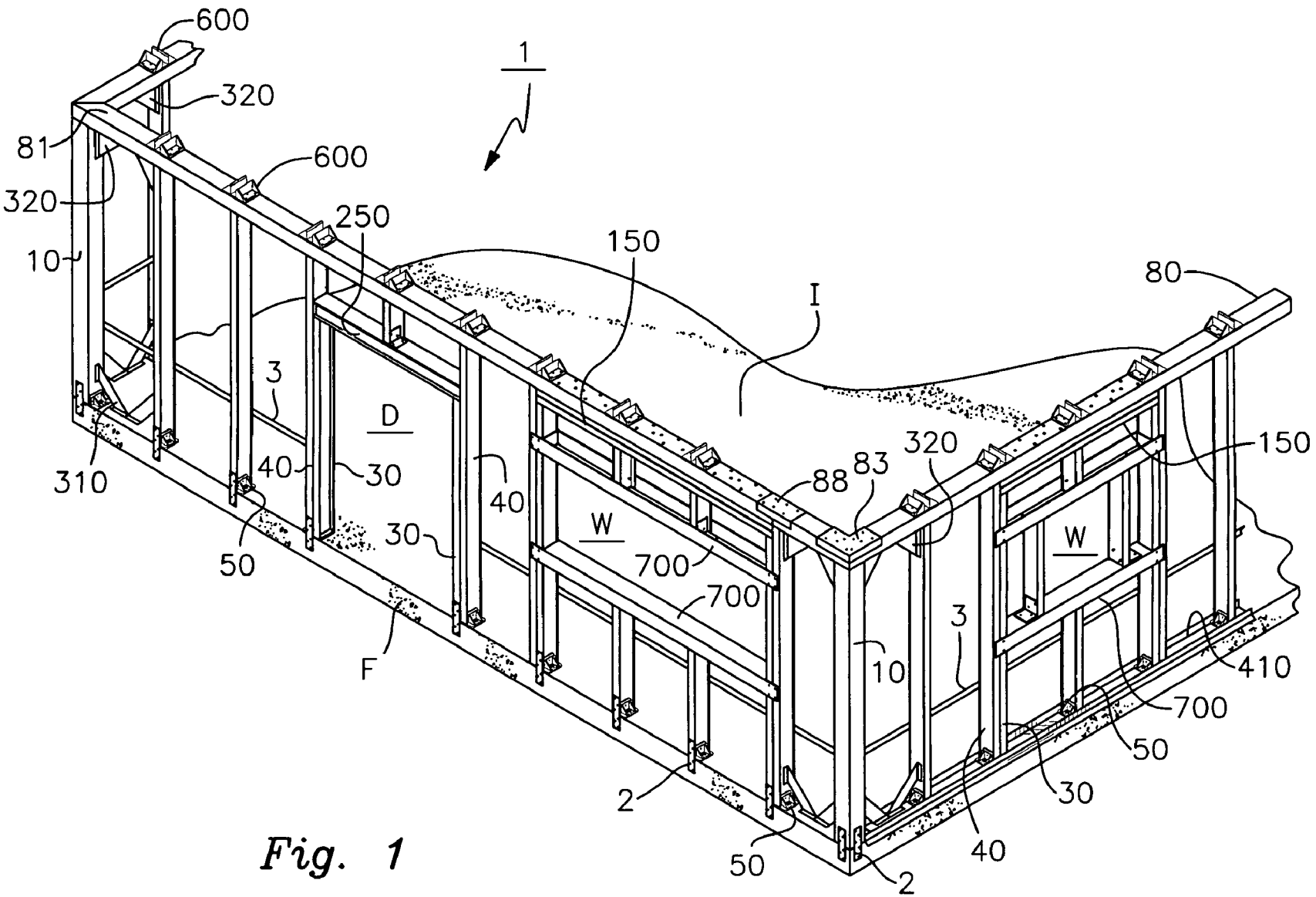
FIG. 1 is a partial perspective view of the inventive framing assembly (single story).
Figure 2:
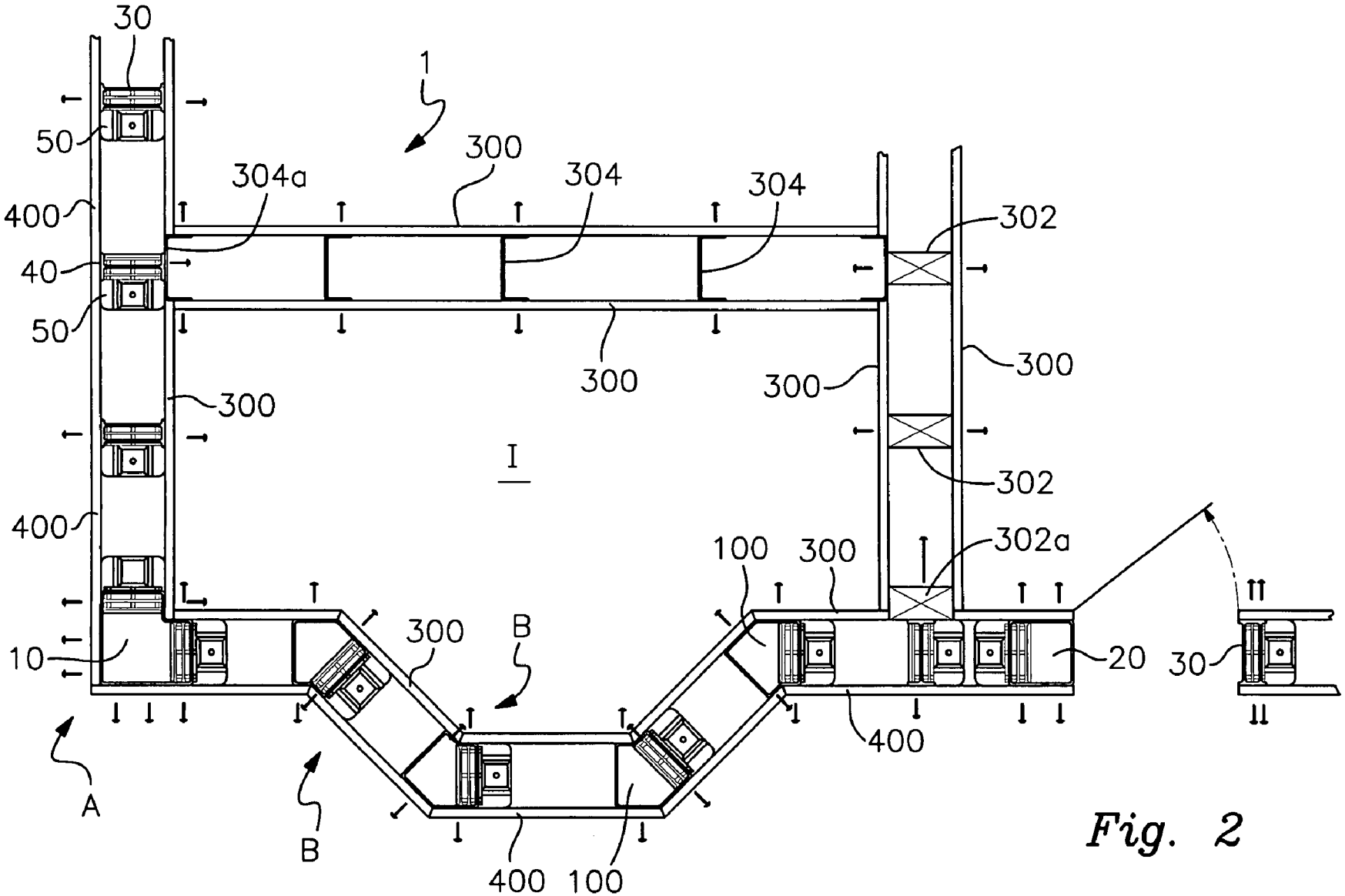
FIG. 2 is a partial top plan view of one exemplary spatial arrangement of the inventive framing assembly.
Figure 3:
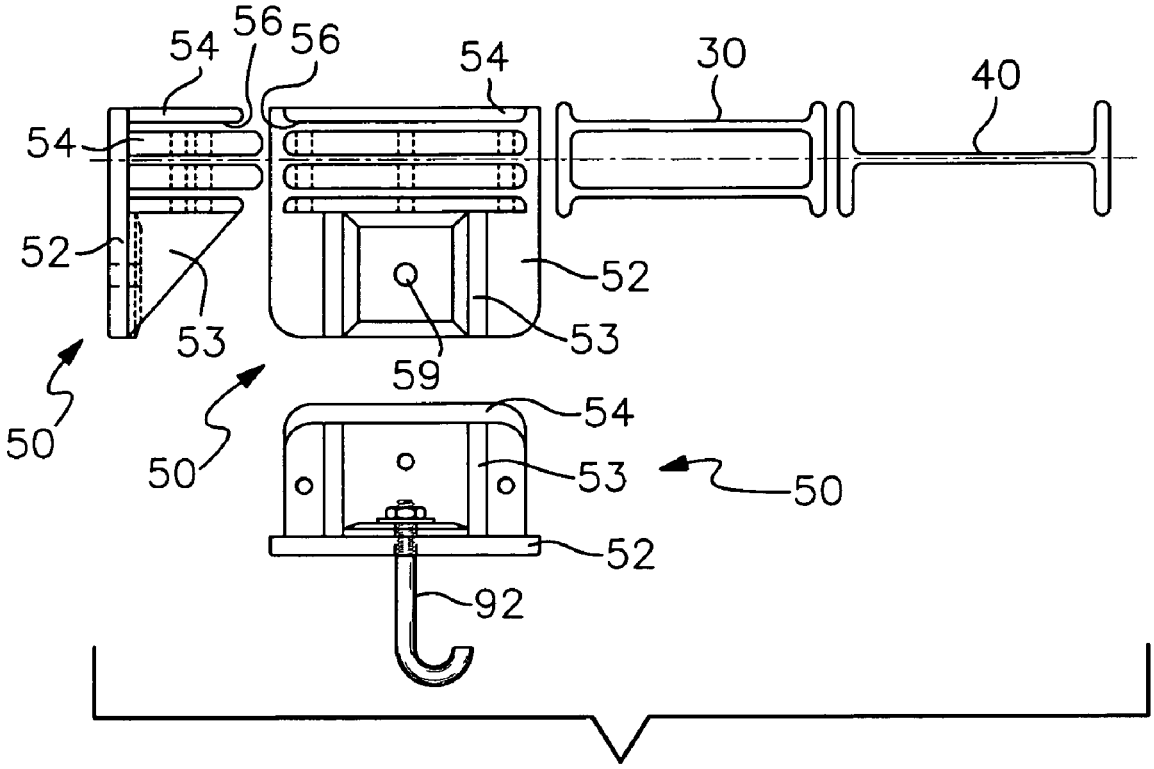
FIG. 3 illustrates top, front, and side views of a first embodiment of the inventive stud mount.

Referring now to the figures, FIG. 1 illustrates a partial perspective view of the inventive structural framing assembly 1 comprising a plurality of stud mounts 50 secured to a floor pad F and a plurality of elongated studs 10, 30,40, each of the studs secured to one or more individual stud mounts 50. FIG. 2 illustrates a partial top plan view of the framing assembly 1, although all headers and stud connectors (as discussed in more detail below) have been removed for ease of illustration. As shown in FIG. 1, stud mounts 50 are secured to the floor pad F engaging a series of elongated structural studs (referenced at 10, 30, and 40 in FIG. 1 and at 20, 20, and 100 in FIG. 2), as discussed in more detail below. The elongated studs in the inventive assembly are arranged parallel to one another, and perpendicular to the underlying floor pad to define, in combination with one another, an interior portion I of the framing (FIG. 2). As used herein, the term "floor pad" shall mean floor pads that comprise the bottom level foundation of a building, typically a concrete foundation, as well as floor pads used to support the flooring of subsequent stories or levels of the building. It will be noted that these latter floor pads which form the flooring of subsequent levels of a multi-story building also form the ceiling of the floor immediately below.

FIGS. 1 and 5-7 show one design of the inventive stud mount. The stud mount 50 comprises a base 52 that is typically secured to the underlying floor pad F. Extending above the base of the stud mount are four parallel plates 54 which are integral with, and perpendicular to, the base. Adjacent parallel plates are spaced apart to define a slot 56 therebetween. The slot 56 is sufficiently wide to engage an edge of the bottom end (or top end) of one of the studs, as described in more detail below with respect to the individual elongated studs of the inventive structural framing assembly. A typical slot width is approximately ⅛ inch to 5⁄16 inch in order to accommodate stud edge widths of about 1⁄16 inch to about ¼ inch, thereby providing a tight fit therein. In addition, one or more bracing plates 53 may be present to give additional structural support to the mount.

Figure 9:
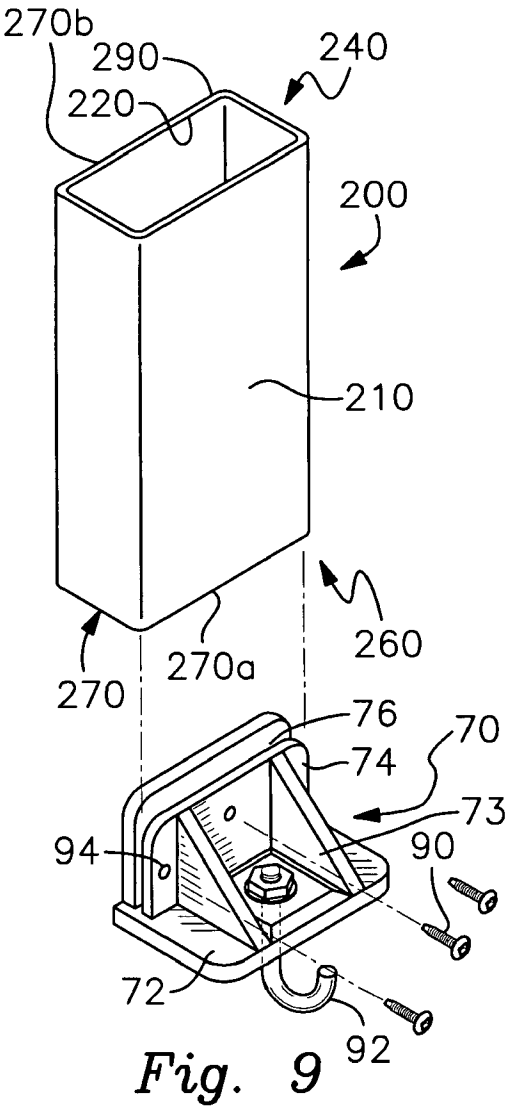
FIG. 9 is an exploded view of a second rectangular stud (oblong shaped) engaged within a third embodiment of the stud mount of the present invention.
Figure 8:
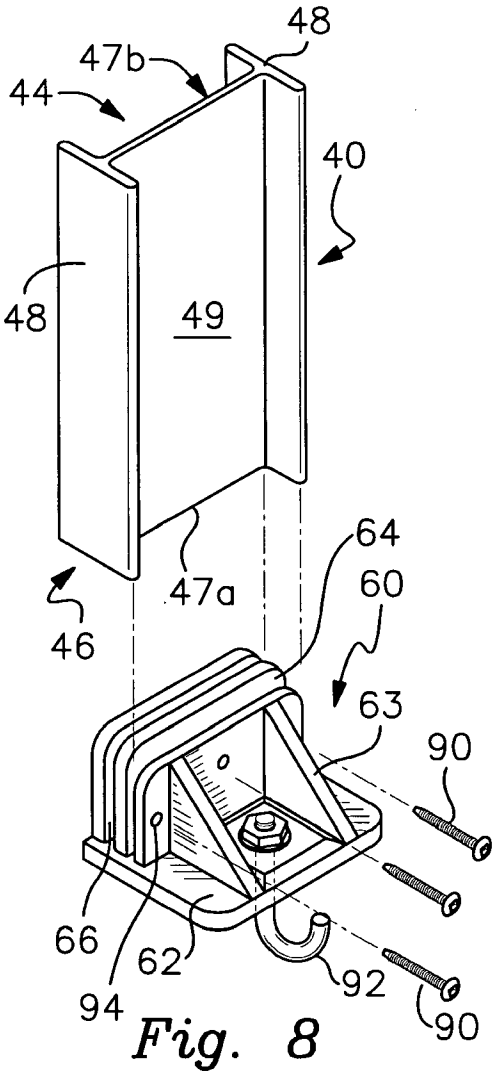
FIG. 8 is an exploded view of a single-I stud engaged within a second embodiment of the stud mount of the present invention.
Figure 25:
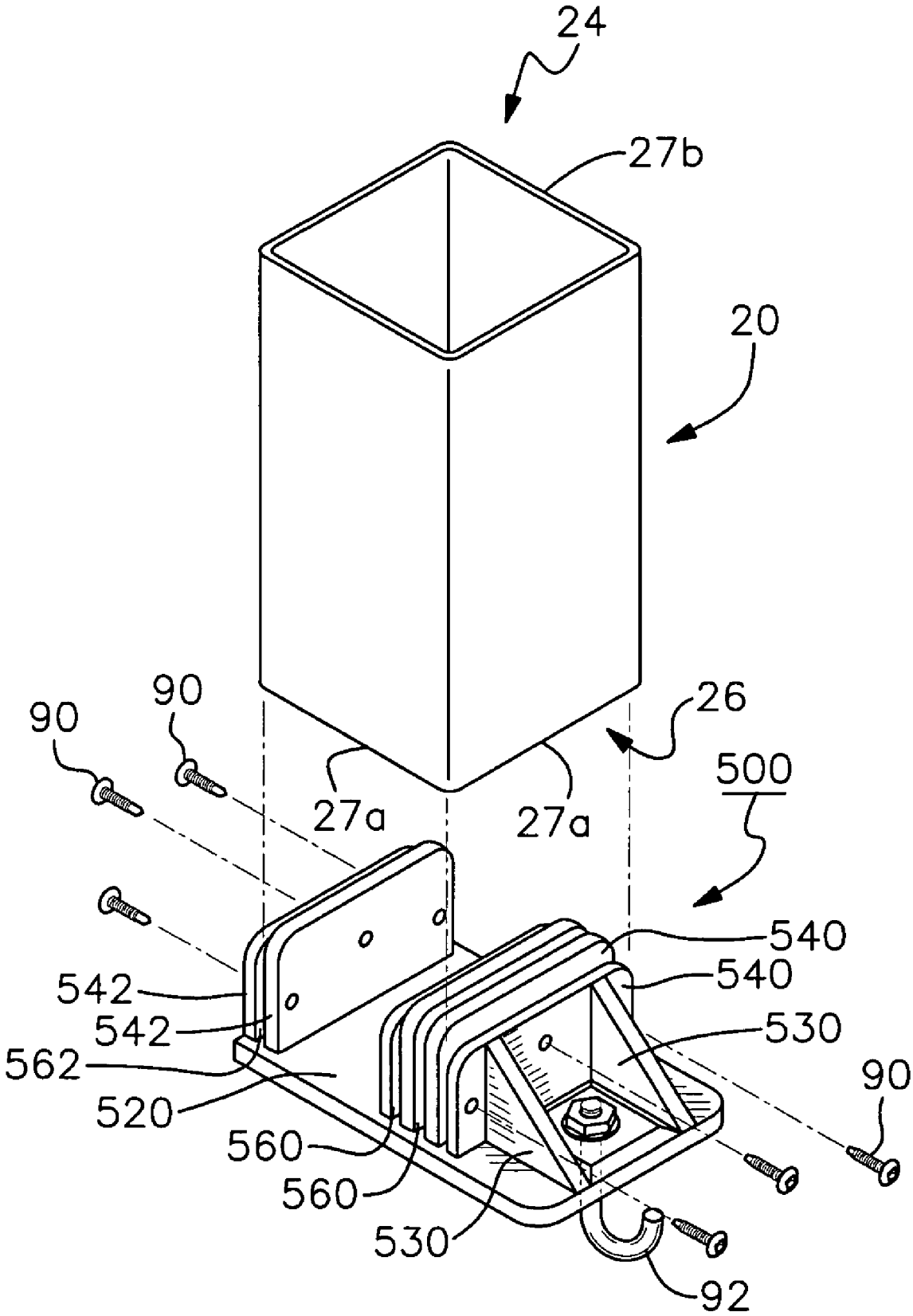
FIG. 25 is an exploded view of a rectangular stud engaged with the fourth stud mount embodiment of the present invention.

FIGS. 8, 9, and 25, illustrate additional embodiments of the inventive stud mount. FIG. 8 illustrates a second design of the stud mount 60 having a total of three parallel plates 64 extending from the base 62, with adjacent plates defining an elongated slot 66 therebetween. FIG. 9 illustrates a third embodiment of the stud mount 70 having a total of two parallel plates 74 extending from the base 72 to define an elongated slot 76 therebetween. For both designs shown in FIGS. 8 and 9, bracing plates 63, 73 may be present to give additional structural support to the mount. Finally, FIG. 25 illustrates an extended stud mount design 500 similar to the foregoing embodiments; however, the base 520 is wider to accommodate a second set of parallel plates 542. More particularly, as shown in FIG. 25, the stud mount preferably comprises a first set of four parallel plates 540 similar to the four-plate stud mount 50 design, with adjacent plates defining elongated slots 560 therebetween. It will be recognized by those of ordinary skill in the art, however, that the first set of plates may comprise more than four plates or only two to three plates. A second set of parallel plates 542, where adjacent plates define an elongated slot 562 therebetween, are positioned a sufficient distance away from the first set of plates in order to accommodate two opposing edges of the bottom end or top end of a stud, such as one of the rectangular studs 20,200 as shown and discussed further below. This second set of plates 542 may include two plates as shown, or three or more plates. As for the other stud mount designs, one or more bracing plates 530 may be present to give additional structural support to the mount 500. In addition, it will be appreciated by the skilled artisan that this stud mount design 500 may be used to secure other stud designs, including those studs illustrated herein as well as modifications thereof.

Figure 35:
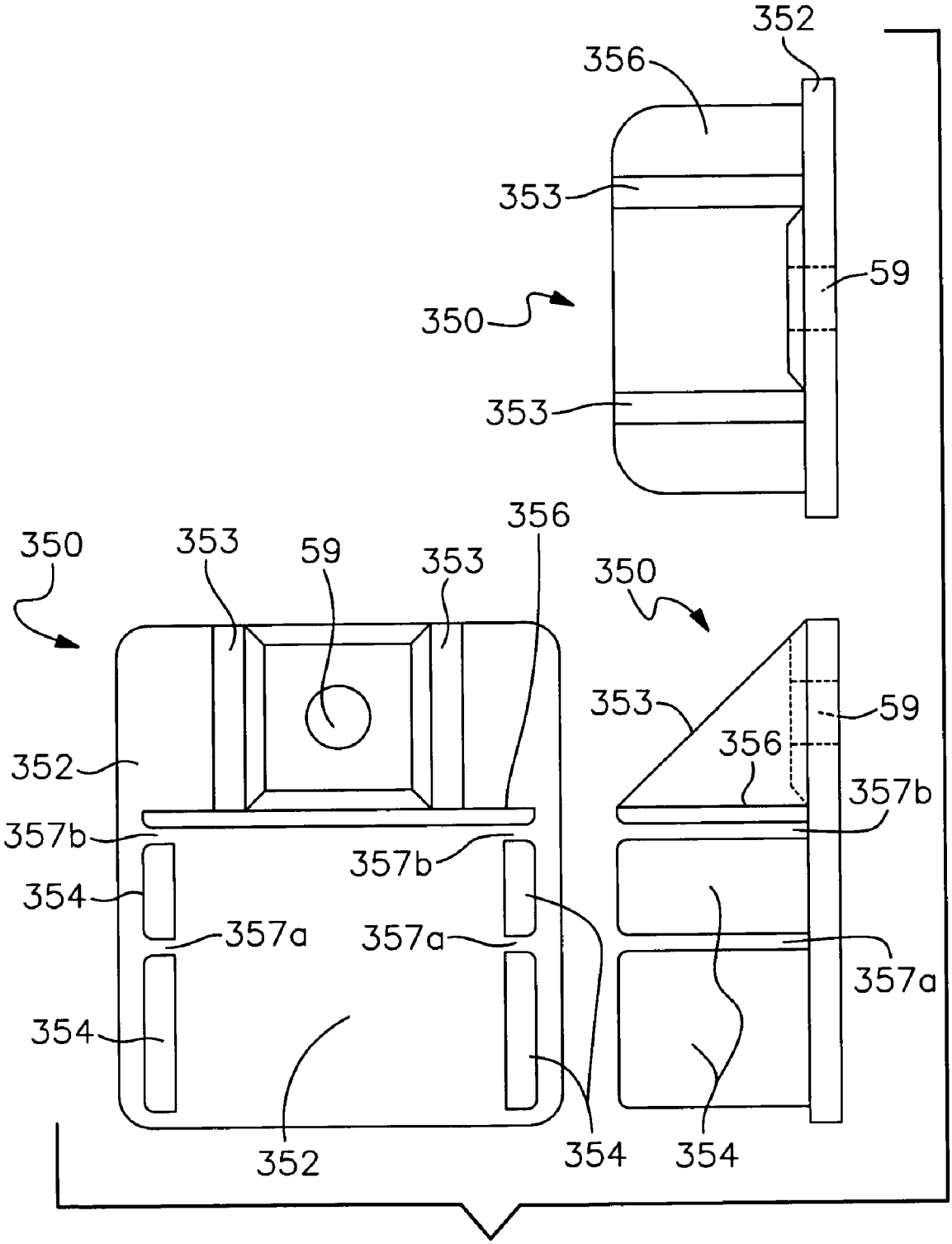
FIG. 35 is a fifth embodiment of the inventive stud mount (top, end, and side views).
Figure 36:
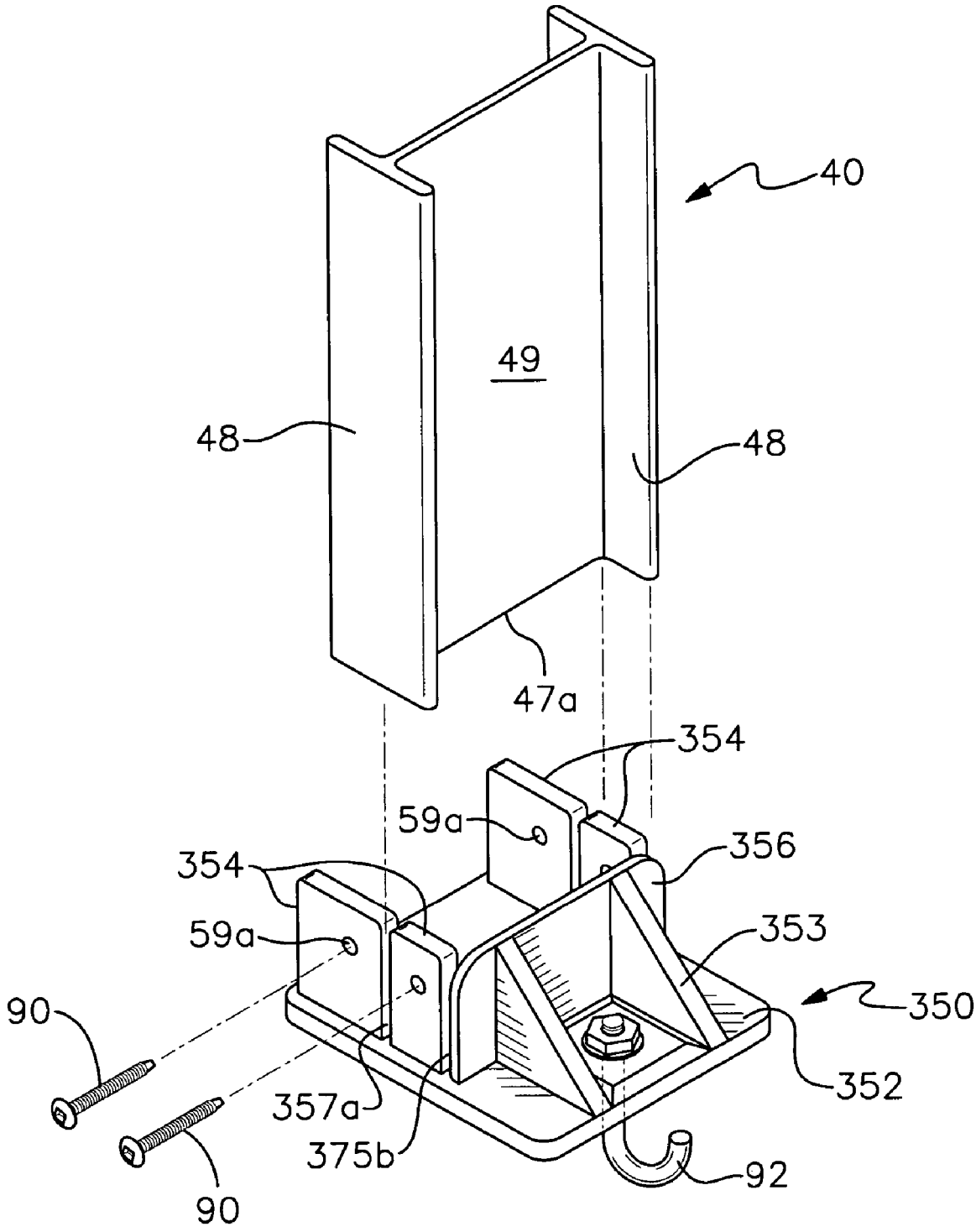
FIG. 36 is an exploded view of a single-I stud (FIG. 8) engaged within the stud mount shown in FIG. 35.
Figure 37:
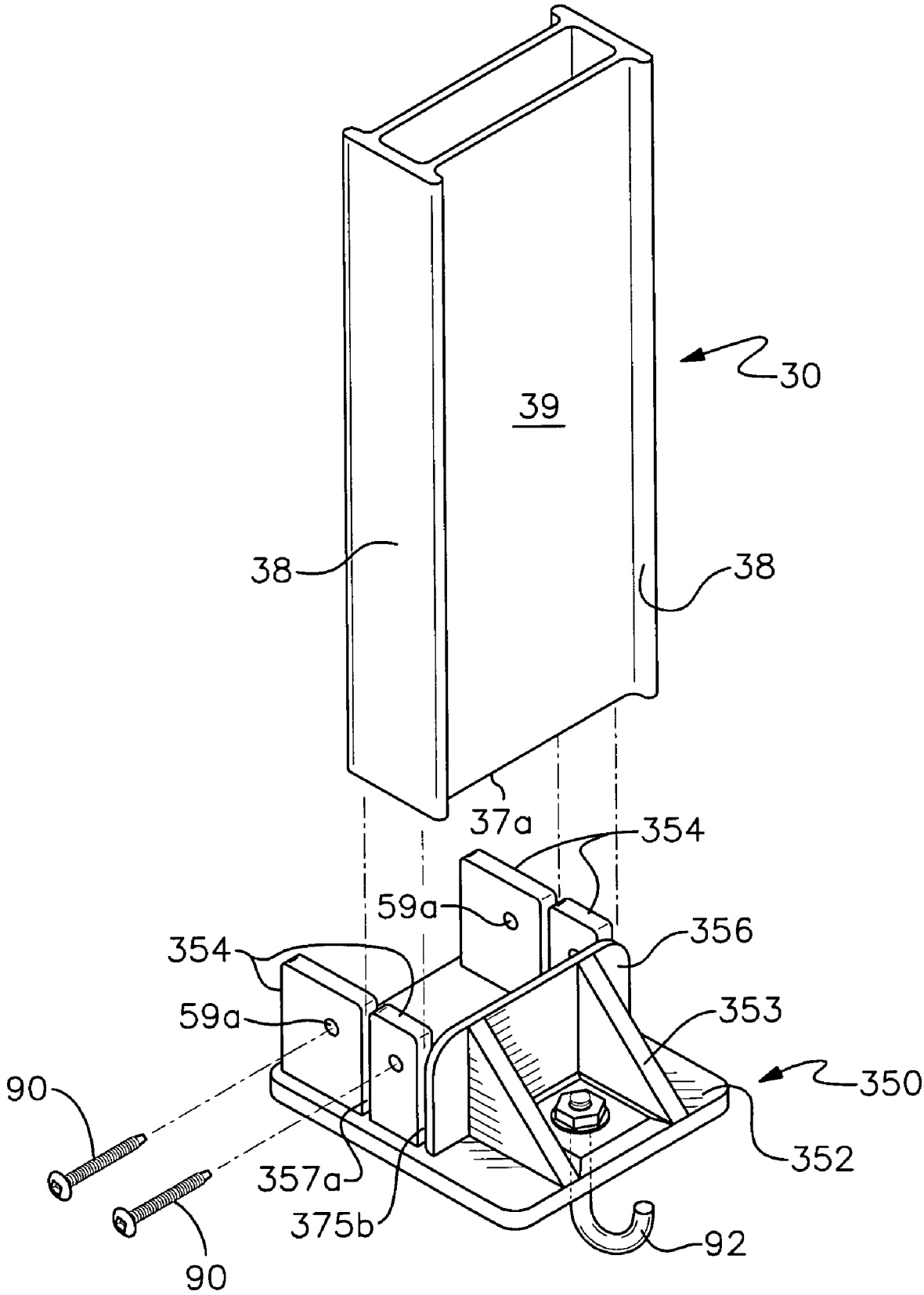
FIG. 37 is an exploded view of a double-I stud (FIG. 5) engaged within the stud mount shown in FIG. 35.

It will be appreciated that most of the figures illustrate all of the stud mount embodiments having parallel plates oriented within the inventive framing assembly such that the plates and elongated slots therebetween run perpendicular to the interior 300 and exterior 400 wall sheets (see FIG. 2, for example). Alternatively, the stud mounts could be turned upon the floor F 90 degrees relative to the positions shown in the figures, such that the plates and corresponding slots run parallel to the walls 300, 400 in order to accommodate other structural stud designs or framing arrangements (not shown). Likewise, the stud mounts could be designed such that the plates themselves are oriented upon the stud mount base 90 degrees from that shown in the figures, again, in order to accommodate other structural stud designs or framing arrangements. Alternatively, a fifth embodiment of the inventive stud mount may be employed, as shown in FIGS. 35-37, wherein the stud mount 350 comprises a base 352, a bracing assembly 353, and two parallel plates 354. When the stud mount 350 is secured to the floor pad F, these plates 354 are oriented parallel with the interior 300 and exterior 400 wall sheets that are later mounted to the framing assembly, as opposed to being perpendicular to the walls sheets, as shown in FIGS. 1-2, for example, for the other stud mount designs. Each plate 354 contains a second slot 357*a* penetrating therethrough, such that the corresponding slots 357*a* of adjacent plates 354 are in registration with one another. These second smaller slots 357*a* preferably penetrate the plates all the way down to the base 352, as shown, and are configured to engage the bottom edge of the stud (see FIGS. 36-37). It will be recognized by the skilled artisan that while FIGS. 35-37 illustrate only one slot 357*a* penetrating each plate 354, additional slots may be provided to accommodate other stud designs. In addition, a slot 357*b* formed between the end the plate 354 and the plate 356 of the bracing assembly 353 may also be employed to engage the top or bottom edge of a stud, as shown in FIGS. 35 and 37. The studs may be secured to the stud mount 350 via fasteners 90 that are drilled through the plates 354 of the stud mount or engaged within pre-existing holes 59*a* of the stud mount plates 354.

Figure 5:
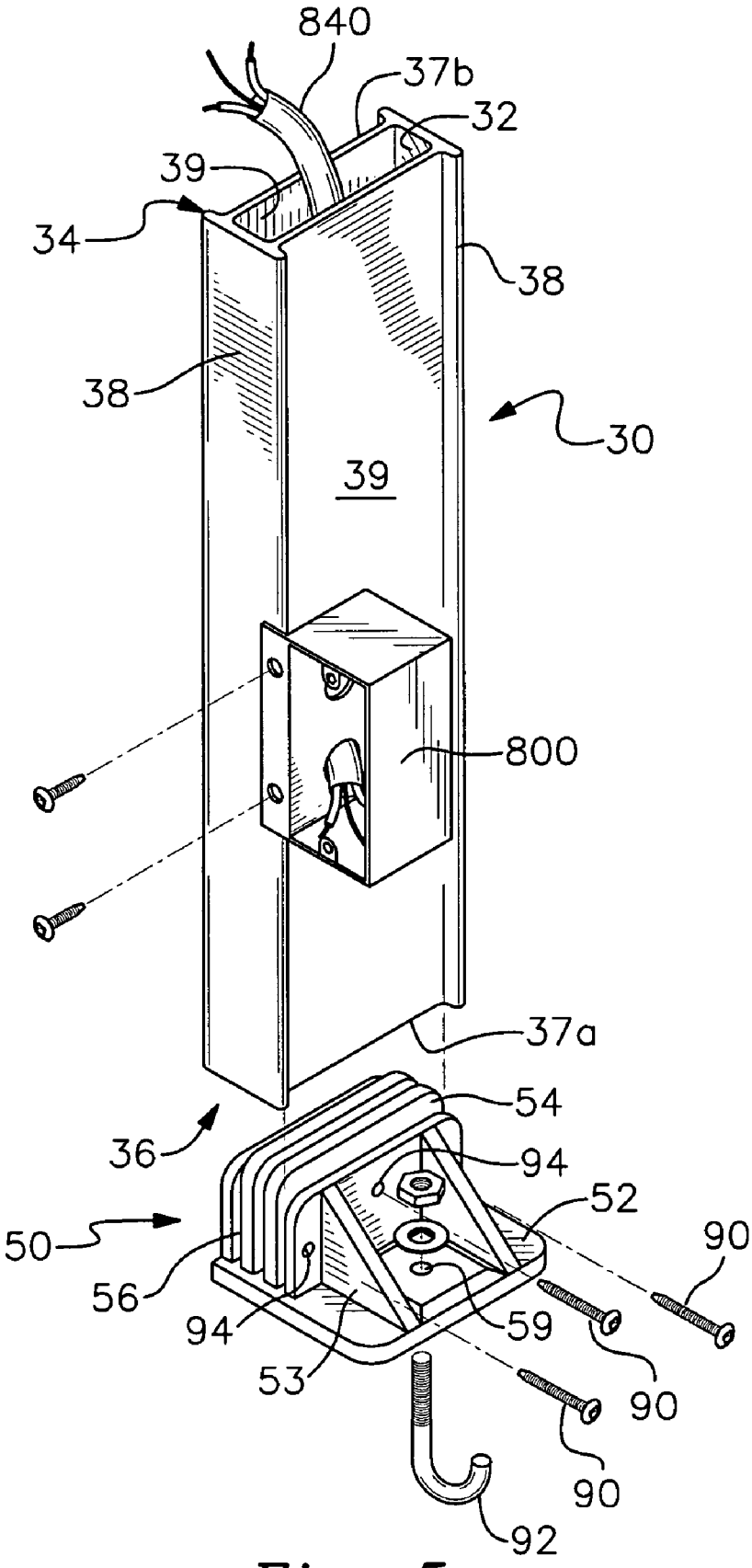
FIG. 5 is an exploded view of a double-I stud engaged within the stud mount illustrated in FIG. 3, and further illustrating the electrical or electronic wiring and attached electrical box.
Figure 6:
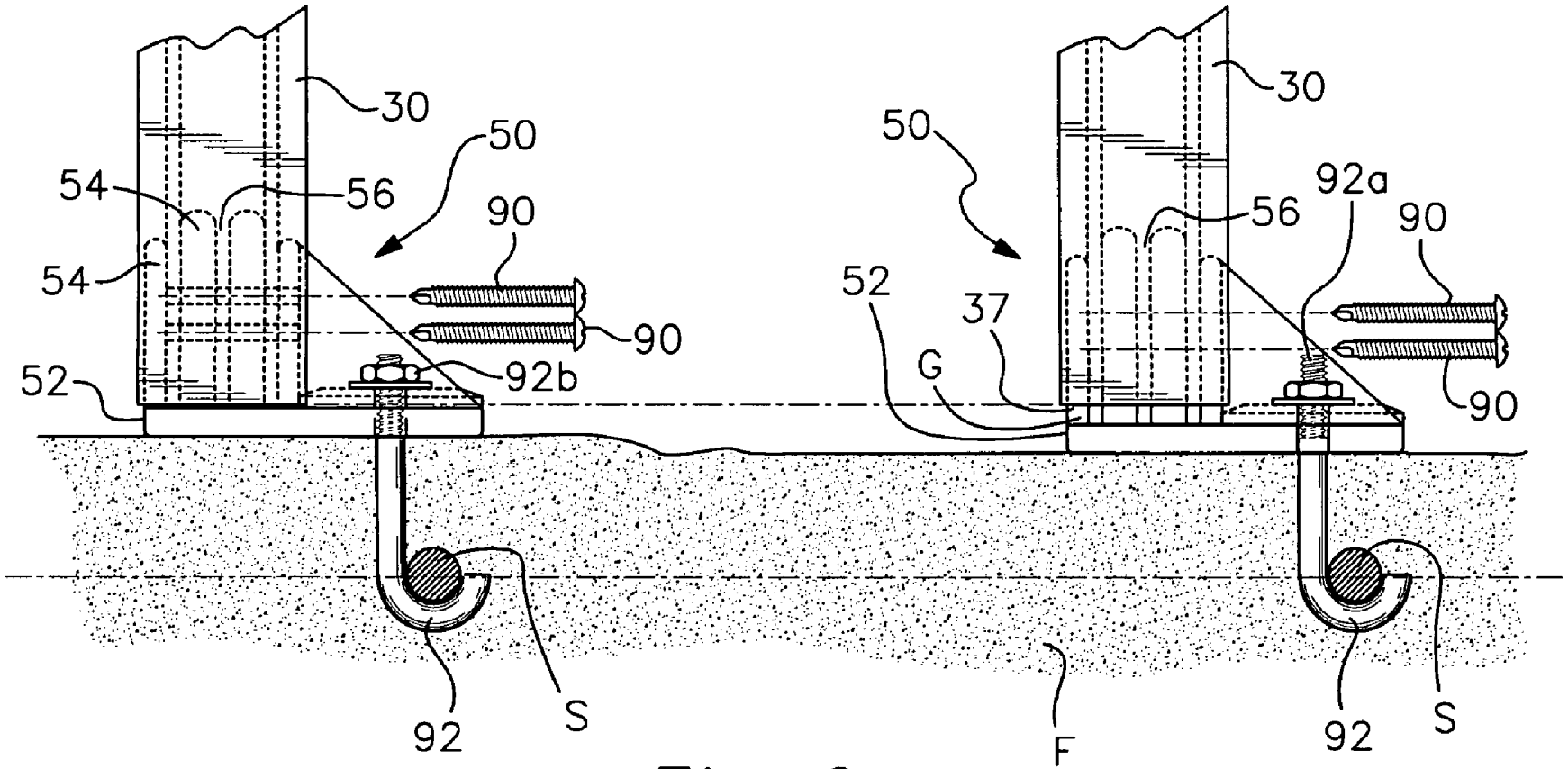
FIG. 6 is a side view of two stud mounts illustrated in FIGS. 3 and 5, each stud mount engaged within a floor pad and illustrating two different height positions for a stud secured therein to an un-level floor pad.

The stud mounts 50, 60, 70, 500, 350 of the present invention may be secured to the floor pad F by any conventional means known those of ordinary skill in the art. A preferred fastening means include J-hooks 92 which are pre-set in the concrete floor pad F. Specifically, the J-hooks are temporarily secured to a top board (not shown) that is set above the concrete form prior to the concrete pour. As best shown in FIG. 6, the J-hook may be secured to a portion of underlying re-bar S placed within the form. Once the concrete is poured, the J-hook is embedded in the concrete and secured to the re-bar S, the threaded end 92*a* of the J-hook extending above the concrete floor pad surface. Once the concrete has cured, the top board is removed, and the stud mount may then be secured to the J-hook by engaging the threaded end of the J-hook 92*a* within a complementary bore 59 of the stud mount base (see also FIG. 5). A nut 92*b* may be used to securely fasten the stud mount to the J-hook. In lieu of a J-hook, other means for securing the stud mount to the underlying floor pad may be employed. For example, the stud mount may be oriented above the floor pad, after which holes are then drilled into the floor pad through the pre-existing bores 59 of the base of the stud mount. The stud mount may then be fastened down by engaging an anchor bolt (not shown) through the drilled hole. The anchor bolt may be further secured within the hole via the use of an epoxy resin or other adhesive previously placed within the drilled hole. Alternatively, instead of using an adhesive, a conventional expansion bolt (not shown) may be fitted into the drilled hole. Once the nut on the top of the expansion bolt is tightened, a pin inside the expansion bolt expands a metal sleeve surrounding the expansion mechanism to form a mechanical pressure inside the bolt hole, thereby securing the bolt within the concrete. Other fastening means include using a nail gun to shoot a concrete nail (not shown) through the bore of the stud mount directly into the concrete. The top of the nail has a washer attached thereto which engages the top of the stud mount. Again, it will be readily recognized by the skilled artisan that the all of these foregoing means for securing the stud mount to the floor pad are fastening methods commonly employed in the construction industry, and thus it will be readily appreciated that other conventional fastening means may also be used to secure the stud mount to the floor pad.

The inventive stud mounts are preferably fabricated of a metal material. Preferred metal and metal alloys include, but are not limited to, steel, stainless steel, aluminum, aluminum alloys, iron, and iron alloys. Other materials, such as composites (as defined and discussed in more detail below), may be used to fabricate the stud mounts, if desired.

Figure 10:
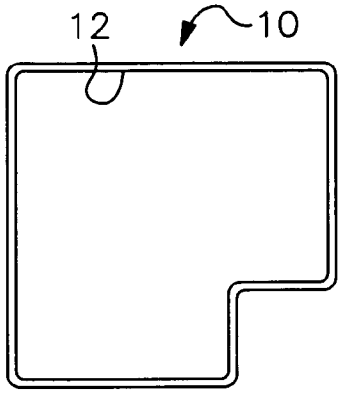
FIG. 10 is a transverse cross section view of a second embodiment of a corner post of the present invention.
Figure 11:
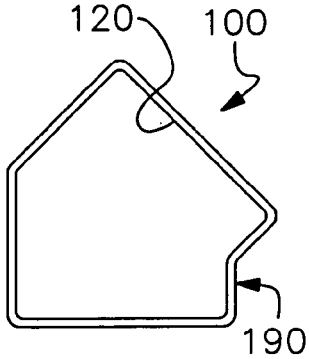
FIG. 11 is a transverse cross section view of a second embodiment of a corner post of the present invention.
Figure 27:
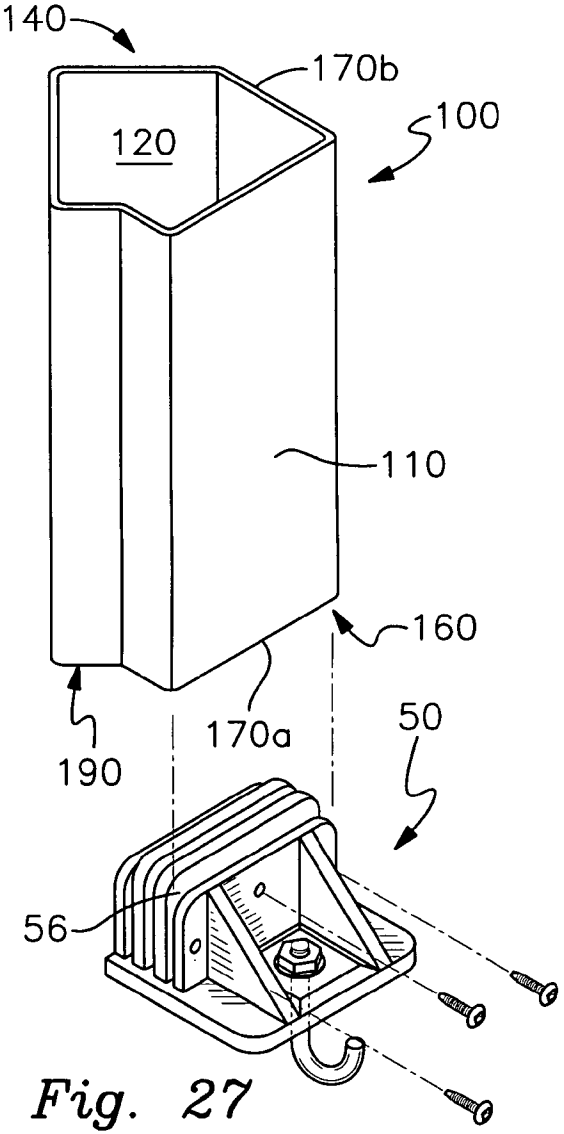
FIG. 27 is an exploded view of the second corner post illustrated in FIG. 11 engaged with the second stud mount embodiment of the present invention.

Referring now to FIGS. 1-2, 10-12, and 26-27, the studs used in the present invention include a set of corner posts 10, 20, 100. A common exterior framing assembly configuration includes at least four corner posts oriented at each corner of a substantially rectangular floor pad. Each corner post 10, 20, 100 has a top end 14, 24, 140 and a bottom end 16, 26, 160, the bottom end 16, 26, 160 having one or more edges 17*a*, 27*a*, 170*a* engaged within the stud mount slots 56. [As discussed in more detail below with respect to multi-story embodiment of the inventive framing assembly, the top end 14, 24, 140 of each post may also have edges 17*b*, 27*b*, 170*b* which may be engaged within the stud mount slots.] FIGS. 10-12 each illustrate a transverse cross section of three exemplary corner post designs. Two corner post 10, 20 designs (see FIGS. 7, 10, 12, 26, and 29-30) are conducive for use at the 90-degree corner areas of the floor pad, indicated generally at A in FIG. 2. FIG. 2 is a partial top plan view of the inventive assembly showing the use of one such corner post 10 (see also FIG. 1). Another corner post design 100, as shown in FIGS. 2, 11, and 27, may be employed in areas where a bay window (generally indicated at B in FIG. 2), for example, may be installed. Those of ordinary skill in the art, however, having the teachings of this disclosure and the prior art, will appreciate that the configuration of these corner posts may be altered even more to accommodate the desired outside spatial arrangement of the framing assembly, with the arrangement illustrated in FIG. 2 being just one of any number of unique framing arrangements.

Figure 12:
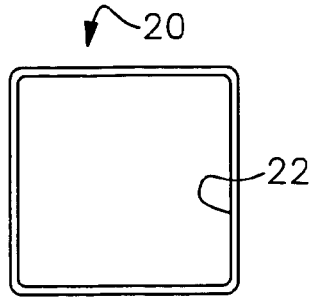
FIG. 12 is a transverse cross section view of the rectangular square stud shown in FIG. 7.
Figure 26:
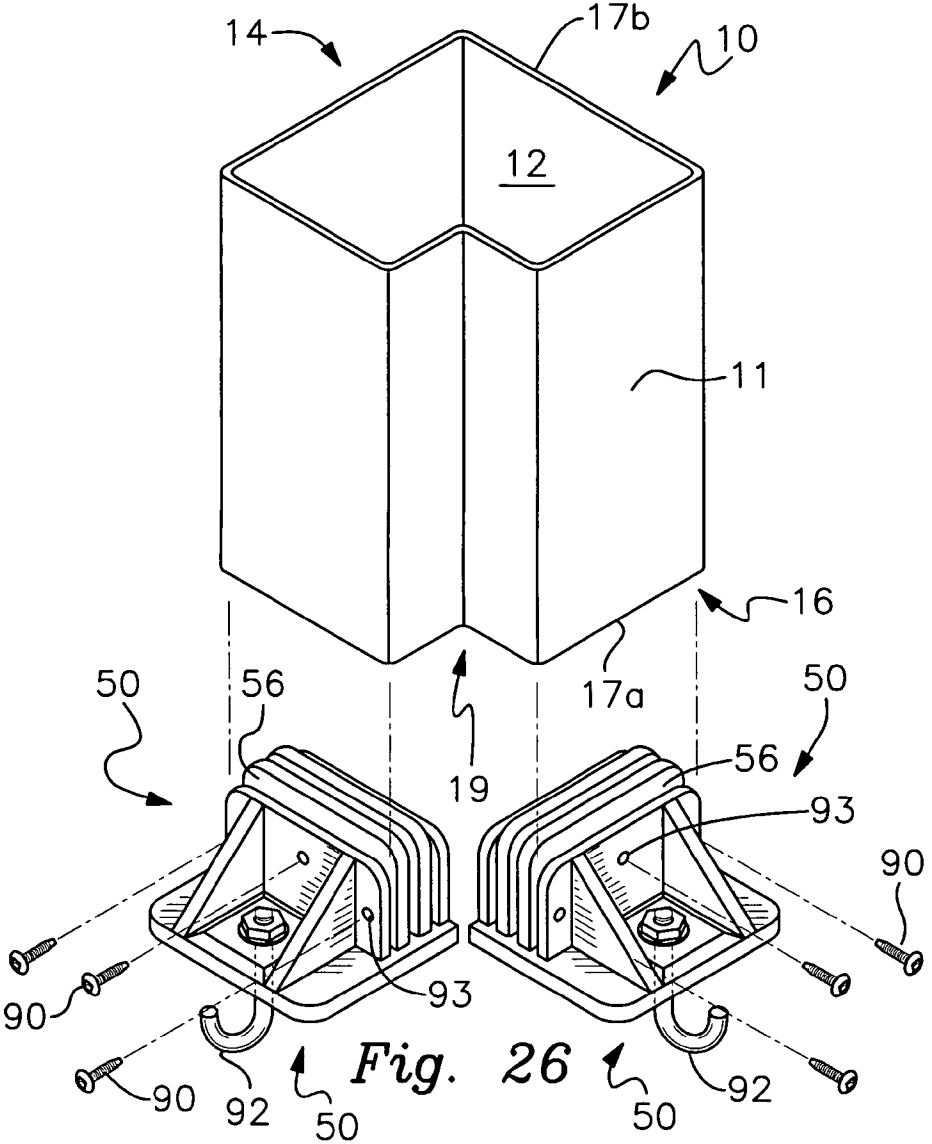
FIG. 26 is an exploded view of the corner post illustrated in FIG. 10 engaged with two stud mounts of the present invention.

The corner posts of the present invention each have a hollow outer body 11, 21, 110, which is preferably solid about the entire circumference, as shown in FIGS. 26-27, defining an inner longitudinal channel 12, 22, 120 extending from the top end 14, 24, 140 to the bottom end 16, 26, 160 of the posts. FIGS. 10-12 illustrate transverse cross-section views of the outer bodies, as shown, to further illustrate the respective inner channels 12, 22, 120. A portion of the outer body for corner posts 10, 100 preferably includes an indentation 19, 190 for receiving an outer edge of an interior wall sheet 300, such as dry wall, for example. Preferred dimensions of these corner posts 10, 100 are 5 inches×5 inches with 1.5 inch indentation widths, while preferred dimensions of the corner post (or stud) 20 is 3.5 inches square. It will certainly be recognized by those of ordinary skill in the art, however, that these corner posts, as well as the other structural studs illustrated herein, may have larger or smaller dimensions or contours, as desired.

Figure 7:
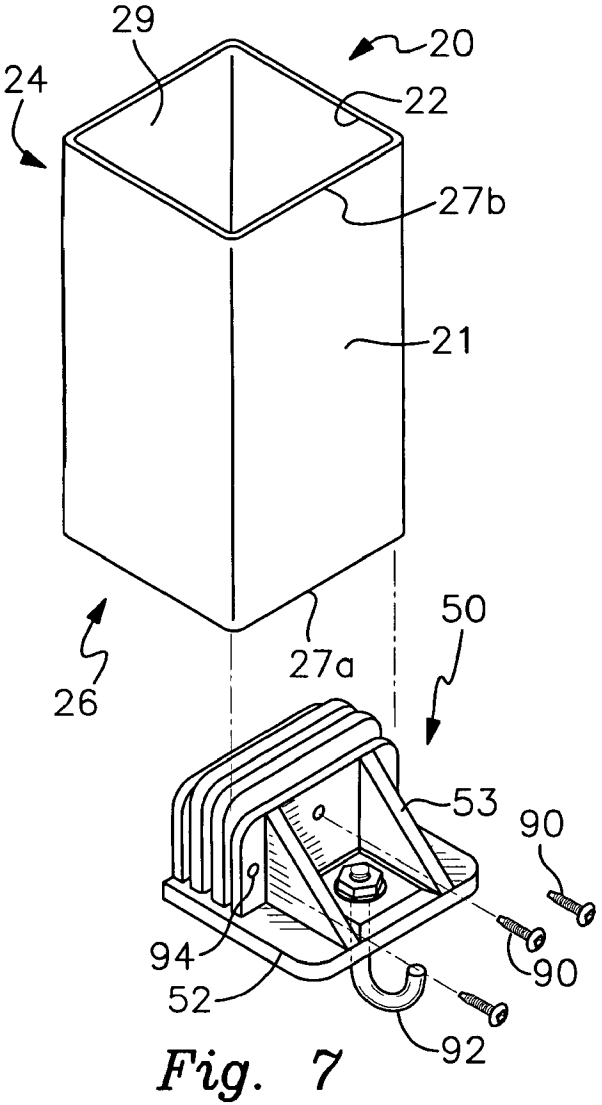
FIG. 7 is an exploded view of first rectangular stud (square shaped) or corner post engaged with the stud mount illustrated in FIG. 3.

FIGS. 7, 26-27 are exploded perspective views of each of the corner post designs engaged within one of the inventive stud mounts 50. Here, one of the edges 17*a*, 27*a*, 170*a* of the bottom end of the corner post is engaged within one of the slots 56 of the stud mount 50, as shown. The four-plate stud mount design 50 is shown in FIGS. 26-27; however, the other inventive stud mount designs 60, 70, 500, 350 may also be used. In addition, as shown in FIGS. 2 and 26, a second bottom edge of the corner post may be engaged within a second stud mount 50 for the corner post 10, 20 embodiments positioned at the corner areas of the framing assembly. With respect to the stud mount 350 shown in FIG. 35, two parallel bottom edges 17*a*, 27*a*, 70*a* of the corner post may be engaged within slots 357*a* and 357*b*. Once placed within the stud mount(s), the corner post may then be secured therein by any suitable fastener, such as a screw 90, driven through one of the pre-drilled bores 93 of the plates. Other suitable fasteners for engaging the corner post therein include, but are not limited to, nails, bolts, adhesives, and the like. Alternatively, fasteners, such as self-drilling screws, may be drilled directly through the stud mount and into the stud in particular for those stud mounts that do not contain pre-drilled bores 93, 59*a*.

Figure 14:
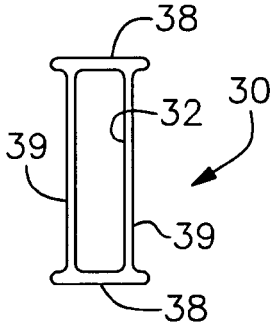
FIG. 14 is a transverse cross section view of the double-I stud shown in FIGS. 5-6.

In addition to the corner posts 10, 20, 100, the inventive framing assembly includes a second set of studs positioned between the corner posts. Regardless of the particular stud configuration, each of the second set of studs has a top end and a bottom end, the bottom end having one or more edges engaged within slots of the stud mount, similar to that of the inventive corner post designs. FIG. 5 illustrates a perspective view of one embodiment of a stud 30. This embodiment has a substantially double-I shaped transverse cross section (see also FIG. 14) with a top end 34 and a bottom end 36. The stud further includes two interior webs 39 and two exterior flanges 38 oriented perpendicularly to the interior webs to define a longitudinal channel 32, the longitudinal channel extending from the top end 34 to the bottom end 36 of the stud. Each of the exterior flanges 38 is suitable for securing thereto a wall sheet, such as an exterior concrete wall sheet 400, for example, or an interior wall sheet 300 of dry wall, for example (see FIG. 2). Each of the interior webs 39 comprises a bottom edge 37*a* of the stud, each edge configured for engagement within one of the slots 56 of the stud mount 50 (see FIG. 5). [The top end 34 of the stud also has top edges 37*b* that may be engaged within the stud mount slots of an inverted stud mount 50B employed in the multi-story embodiment of framing assembly, as discussed further below (FIG. 34).] FIG. 5 shows the stud 30 secured within a four-plate stud mount 50; however, it will be appreciated by the skilled artisan that one of the other stud mount designs, such as the three-plate stud mount 60, may be employed (e.g. for the engagement of two bottom edges 37*a* of the stud) or the two plate stud mount 70 (e.g. for engagement of one of the two bottom edges 37*a*). Alternatively, the stud mount 350 design illustrated in FIG. 35 may be employed, wherein the two interior webs 39 of the stud are engaged within the narrower slot 357*a* of the stud mount plates 354 and slot 357*b* provided between the bracing plate 356 and plate 354, such that the interior webs 39 run perpendicular to the adjacent plates 354 of the stud mount (as opposed to parallel, as shown in FIG. 5). In this design, the double-I stud is fastened to the stud mount plates 354 via the exterior flanges 38 (see FIG. 37).

The double-I stud 30 is particularly well-suited for electrical wire containment (discussed further below) and used when heavy roof loads are encountered in snow areas or flat roof construction, or when high wind pressures may be encountered in hurricane or tornado conditions.

Figure 15:
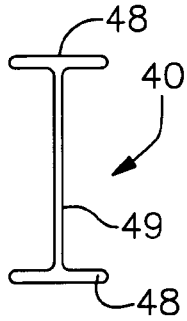
FIG. 15 is a transverse cross section view of the single-I stud shown in FIG. 8.

FIG. 8 is a perspective view of a second embodiment 40 of one of the second set of studs. This embodiment also has a top end 44 and bottom end 46 as well as a substantially single-I shaped transverse cross section, including two exterior flanges 48 secured to a single interior web 49 oriented perpendicular to the exterior flanges 48 (see also FIG. 15). Each of the exterior flanges is suitable for securing thereto a wall sheet, such as dry wall or an exterior concrete sheet, for example. The interior web 49 includes the bottom edge 47*a* of the stud that is engaged within one of the slots 56 of the stud mount 50. [The top end 44 of the stud also has a top edge 47*b* that may be engaged within the stud mount slots in the multi-story embodiment of framing assembly, as discussed further below.] As discussed above for the double-I stud embodiment, FIG. 8 shows the single-I stud 40 secured within the three-plate stud mount 60; however, it will be appreciated by the skilled artisan that one of the other stud mounts, such as the four-plate stud mount 50 design or the two plate stud mount 70 design, may be employed. Alternatively, as discussed above for the double-I stud embodiment, the stud mount 350 design illustrated in FIG. 35 may be employed, wherein the interior web 49 of the stud is engaged within the narrower slot 357*a* of the stud mount plates 354, such that the interior web 49 runs perpendicular to the adjacent plates 354 of the stud mount (as opposed to parallel, as shown in FIG. 8). In this design, the single-I stud is fastened to the stud mount plates 354 via the exterior flanges 48 (see FIG. 36).

The single-I stud 40 is particularly well-suited for attaching interior walls to exterior walls via a C-channel stud 304*a* (see FIG. 2), wherein the latter stud 304*a* is secured to the inner flange 48 of the single-I stud 40 as shown, or for securing interior walls to exterior walls via a wooden stud 302*a*, as shown in FIG. 2, wherein the latter stud 302*a* is secured to one of the flanges 48 of the single-I stud. 40. The single-I stud is also well suited for areas on the framing assembly designed to support standard roof loads and to withstand medium wind pressures, and/or for use in manufactured homes, trailer homes, motor homes, or travel trailers.

FIG. 7 is a perspective view of a third embodiment of one of the second set of studs. This embodiment 20 has an outer body 21 with a substantially rectangular, more specifically square, transverse cross section (see FIG. 12) As discussed above, this stud embodiment may also be used as a corner post. Like the other stud embodiments, this stud 20 has a top end 24 and a bottom end 26. The stud also includes an inner longitudinal channel 22 similar to the other corner post channels 12, 120 and the double-I stud channel 32 discussed above, wherein the channel 22 extends from the top end 24 to the bottom end 26 of the stud. The bottom end 26 of this stud has a total of four edges 27*a*, one of which is engaged within one slot 56 of the stud mount, as shown. [The top end 24 of the stud also has top edges 27*b* that may be engaged within the stud mount slots in the multi-story embodiment of framing assembly, as discussed further below.]

Figure 13:
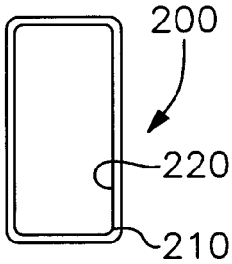
FIG. 13 is a transverse cross section view of the second rectangular oblong stud shown in FIG. 9.

FIG. 9 is a perspective view of a fourth stud embodiment 200. This stud embodiment may also function as a corner post singularly or in combination with other similar studs or with studs having different shapes, but not typically. This embodiment 200 also has an outer body 210 forming a longitudinal channel 220 and a substantially rectangular oblong transverse cross section (see FIG. 13). Like the other stud embodiments, this stud 200 has a top end 240 and a bottom end 260. The inner longitudinal channel 220 is similar to the corner post channels 12, 120, double-I stud channel 32, and rectangular square stud channel 22 discussed above. The bottom end 260 of this stud has a total of four edges 270*a*, one of which is engaged within one slot 56 of the stud mount, as shown. [The top end 240 of the stud also has top edges 270*b* that may be engaged within the stud mount slots of an inverted stud mount used in the multi-story embodiment of framing assembly, as discussed further below.]

As discussed above for the double-I stud 30 and single I stud 40, FIGS. 7 and 9 show the rectangular studs 20, 200 secured within the four-plate stud mount 50 and two-plate stud mount 60, respectively; however, it will again be readily appreciated by the skilled artisan that one of the other stud mount designs may also be used. With respect to the square stud mount 20, the elongated stud mount 500, illustrated in FIG. 25 should preferably be used for securing two edges 27*a* of the stud within the stud mount when necessary or desired. Alternatively, the stud mount 350 design illustrated in FIG. 35 may be employed, wherein the two parallel bottom edges 27*a*, 270*a* of the stud may be engaged within the narrower slot 357*a* of the stud mount plates 354 as well as slot 357*b* provided between the bracing plate 356 and plate 354, depending upon the dimensions of the respective studs, stud mounts, and slots within the stud mount, in particular the width of the slots and thickness of the bottom or top edges of the studs.

Both the square and oblong rectangular stud embodiments 20, 200 are particularly well-suited for decorative vertical supports and for supporting porticos, carports, awnings, decks, docks, fences, screen rooms, glass rooms, patios, and lanais.

One unique feature of the present invention is the ability to adjust the height of the studs within the stud mount in order to accommodate any uneven or un-level surface areas of the floor pad F. As best shown in the left-hand view of FIG. 6, the stud 30 may be engaged completely down within the selected slot(s) of the stud mount 50, such that each bottom edge 37*a* of the stud is in contact with the upper surface of the base 52 of the stud mount. Alternatively, as shown in the right hand view of FIG. 6, the stud 30 may be engaged only partially within the selected slot(s), such that there is a gap G between the bottom edge 37*a* of the stud and the stud mount base. By allowing for such height adjustment, studs of a single length may be adjusted for use on the construction site, thereby obviating the need for cutting a variety of different length studs. It should be noted that for ease of illustration and discussion, FIG. 6 shows the use of a double-I stud 30 engaging a four-plate stud mount 50; however, it will be readily appreciated by those of ordinary skill in the art that the other stud mount embodiments 60, 70, 500,350 illustrated and described herein also provide for the same type of height adjustment. Once the corner post or other studs are engaged within the stud mounts, mechanical fasteners 90, such as screws, or construction adhesives for example, may be inserted through pre-drilled holes 94 present in adjacent stud mount plates, thereby securing the stud therein, or self-drilling screws may be used where there are no pre-drilled bores.

Figure 34:
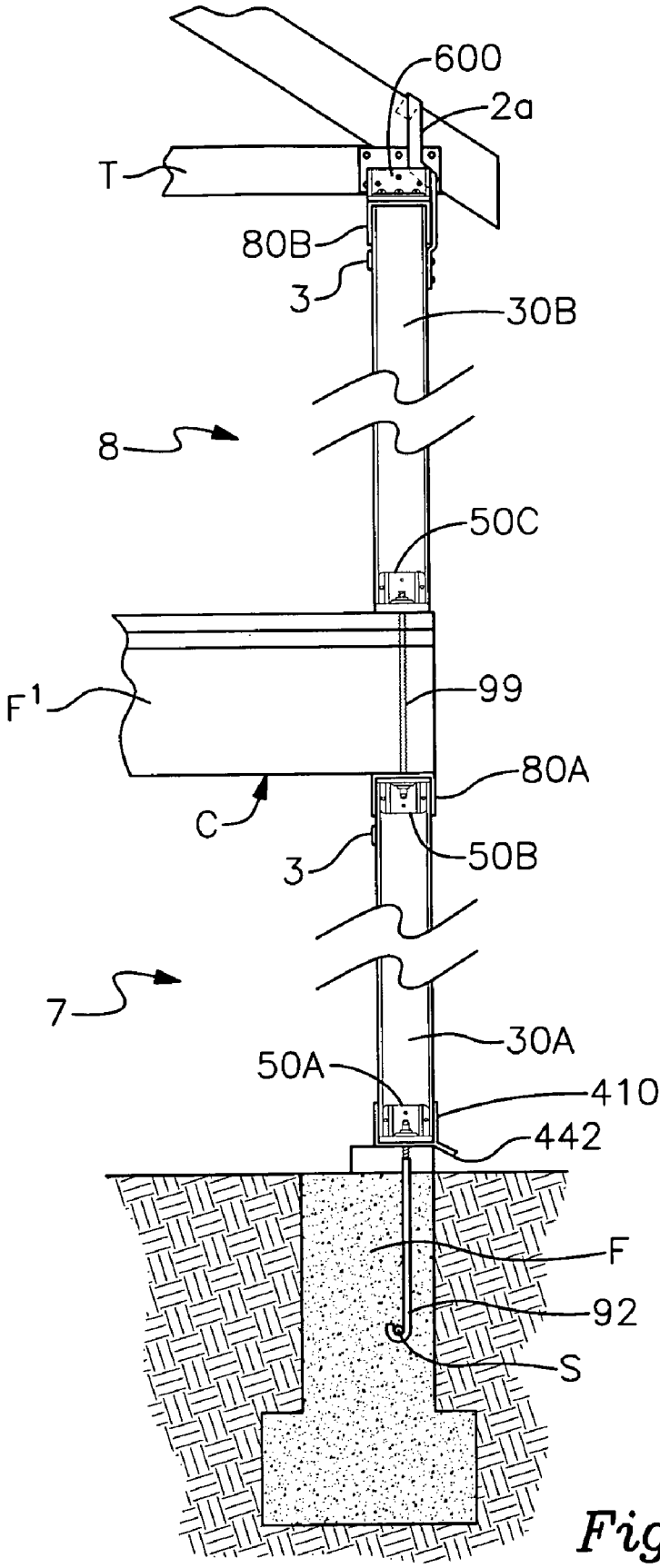
FIG. 34 is a side perspective view of a two-story embodiment of the inventive framing assembly.

The inventive framing assembly may also be applicable to multi-story buildings. FIG. 34 is a perspective side view of a two-story embodiment of the present inventive framing assembly. The multi-story framing assembly embodiments are similar to the single-story framing assemblies, with the main difference in the preferred embodiment being that the structural studs 30A on the first floor 7 (i.e. ground story) are secured to both the underlying foundation (i.e. floor pad F) and may also be secured to the top of the first floor C by the inventive stud mounts. [Note that the floor pad $F^1$ of the second story 8 comprises the ceiling C of the first story 7.] The bottom edge(s) of the stud 30A are secured within a first stud mount 50A, as described above, which in turn, is fastened by screws or bolts to the floor pad F, preferably by a J-hook 92, as shown in FIG. 34 and as described for the single-story framing assembly of the present invention. The edge(s) of the top end of the same stud are also secured within the recess(es) of an inverted second stud mount 50B, which in turn, is bolted to the ceiling C, as shown in FIG. 34. The inverted second stud mount 50B is preferably spaced at regular intervals about the ceiling C. Preferably, the first floor stud 30A is aligned with the stud mount 50C securing a second story stud 30B, such that the two studs 30A, 30B are in registration with one another. Moreover, the top inverted stud mount 50B of the first story stud 30A and the bottom stud mount 50C of the second story stud 30B are oriented with respect to each other such their respective base bores 59 (not shown in FIG. 34, but shown, for example, in FIG. 5) are also aligned such that the two stud mounts can be connected to one another through the second story floor pad $F^1$ by a threaded rod 99. While other means may be employed for securing the respective first and second story stud mounts to the second story floor pad, the use of the rod 99 as shown is advantageous in that it eliminates the need for outside strapping and aligns a continuous structural load path. Finally, while the four-plate stud mount 50 design is illustrated in FIG. 34, it will be recognized that the other stud mount designs described and illustrated herein may be employed for the inventive multi-story framing assembly.

Both the rectangular studs 20, 200, double-I stud 30, and other corner post 10 may be used as conduits through which electrical and electronic transmission wires 840 may be housed. FIG. 5 illustrates the use of a double-I stud 30 for this purpose. Here, the wires 840 are run through the top end 34 of the stud 30, through inner channel 32, and exit through a small hole previously drilled through the outer body of the stud. Aligned over this hole through which the wires exit is an electrical housing 800 attached to the side of the stud. Exemplary electrical transmission wires 840 which may be housed within the studs include, but are not limited to, electrical wires for transmitting electricity throughout the building, telephone wires, television cables, audio cables, computer cables, fiber optics, and the like. The wires 840 may also exit through a small hole drilled through the connecting members 80, 81 which are secured to the top end of the stud over the stud channel 32.

Figure 33:
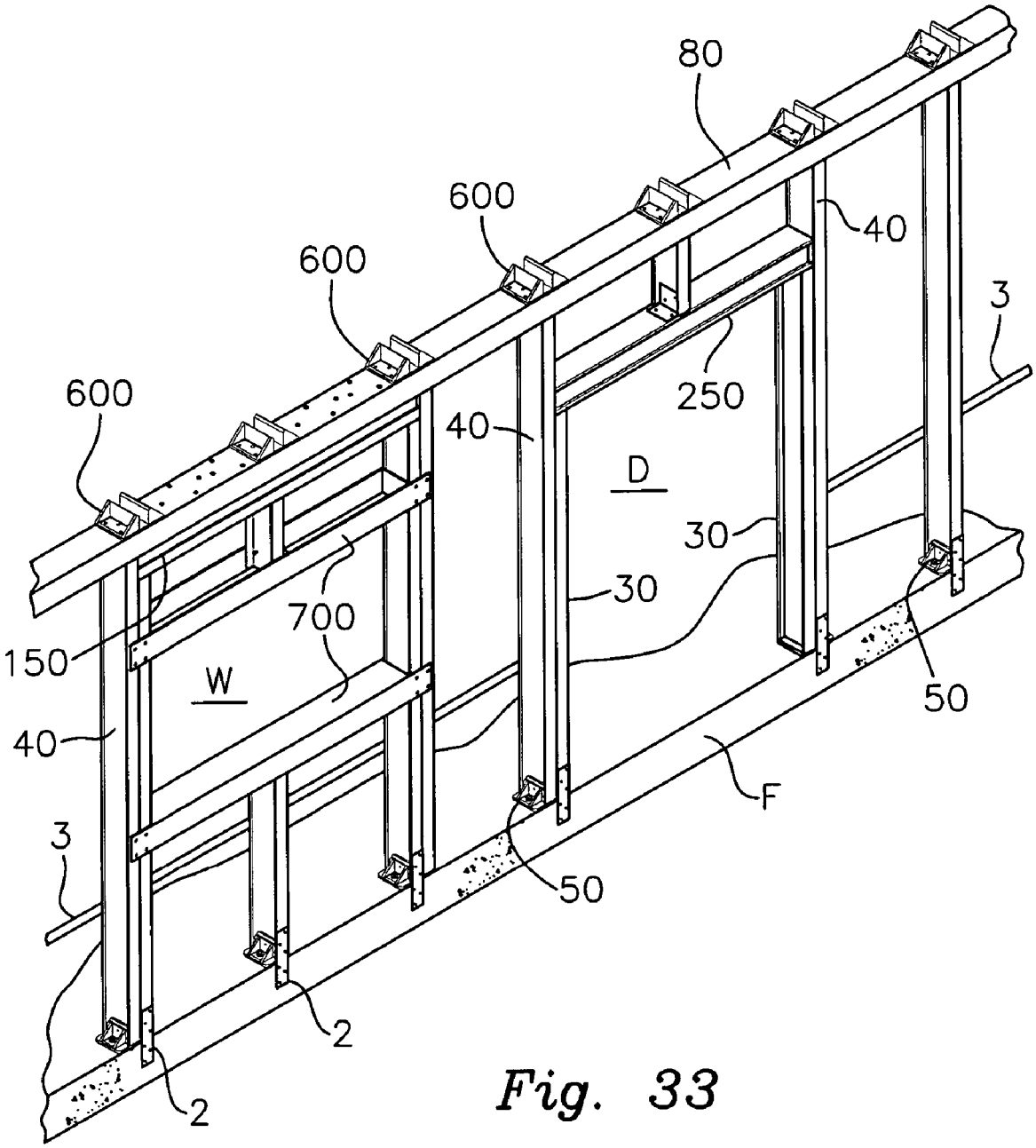
FIG. 33 is a partial front view of the inventive framing assembly (single story).

In order to provide further structural support and uplift support, a plurality of straps 2 may be employed, as shown in FIGS. 1 and 33, for example. The straps 2 may be of any conventional type and are secured to the floor pad via screws or nails, for example, or previously cast into the concrete floor pad according to the manufacturer's instructions. Suitable straps include straps manufactured by Simpson Strong-Tie Company, Inc. (Pleasanton, Calif.), as illustrated in Simpson Strong-Tie Company, Inc.'s Catalog C-HW2000, titled *High Wind-Resistant Construction Product Guide* (September 2000) and which is incorporated herein by reference in its entirety. Specifically, conventional straps used to further secure a stud to the floor pad, conventional straps (not shown) used to secure first floor studs to second floor studs, and conventional straps for securing studs to the trusses, preferably straps 2*a* that go over the truss (FIG. 34), may be employed.

Figure 22:
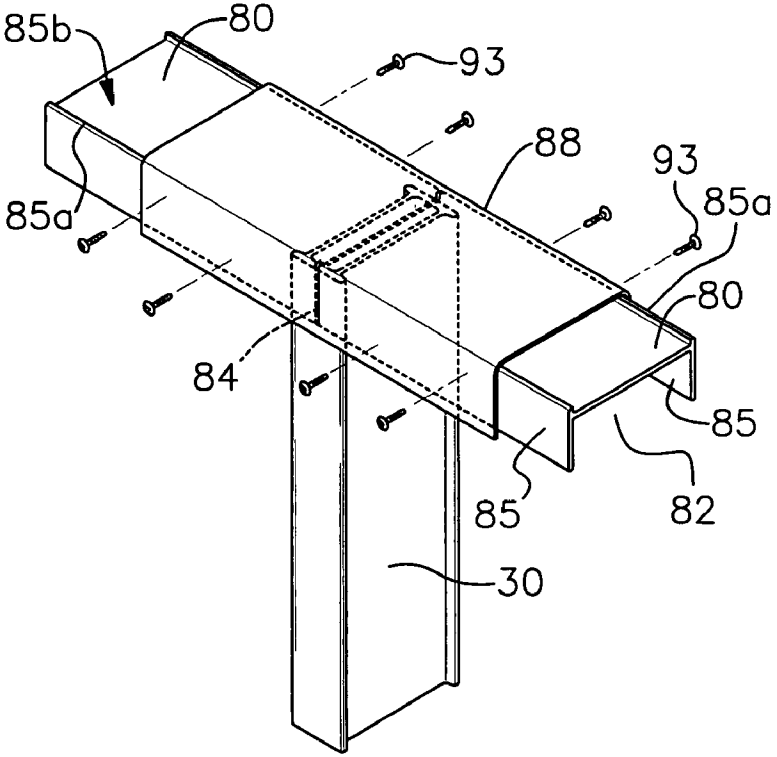
FIG. 22 is a perspective view of two connecting members secured to a double-I stud of the present invention.

Referring now to FIGS. 1 and 22, certain aspects of the present invention further include a series of elongated connecting members 80 spanning two or more adjacent studs. Preferably, the connecting members 80 have a C-channel configuration as shown in the figures, each having an inner channel 82 defined in part by two side walls 85 secured to a top surface 85*b*, the inner channel configured to engage the top end of adjacent structural studs or corner posts. Adjacent connecting members 80 are preferably oriented such that an opposing end 84 of one connecting member is aligned in registration with an opposing end 84 of the other member directly above the top end of a stud, as shown in FIG. 22. Connecting members 80A, 80B are similarly used in the multi-story framing assembly, as shown in FIG. 34. The first story stud mount 50B is preferably secured to the connecting member 80A, as shown. Similarly, the top end of the second story (or top story) stud 30B is engaged within the recess of the connecting member 80B, as shown.

It is noted that for ease of illustration and discussion, the connecting member 80 is shown in FIG. 22 secured to a double-I stud 30; however, it will be recognized that the connecting members are used to secure the other stud designs described herein, as well. With respect to the corner posts 10, 20, 100, the connecting members 81 securing a corner post to a second stud each have one end that is cut at an angle (e.g. 45-degree angle), so that the two ends, when aligned, may mate to form a 90-degree angle in order to accommodate the 90-degree angle of the corner of the framing assembly (see FIGS. 1, 29, and 30). Where the two ends of the connecting members 81 meet is referenced generally at 85'.

Figure 29:
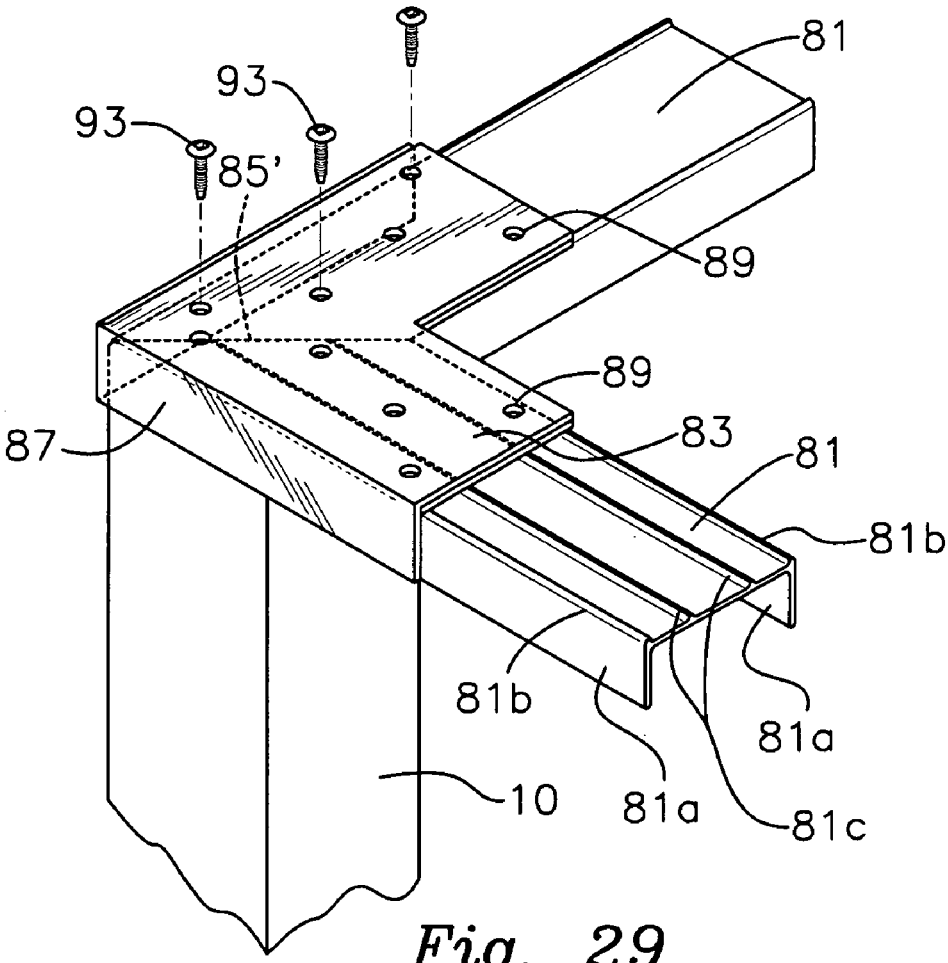
FIG. 29 is a partial perspective view of the corner connecting member of FIG. 28 secured to the corners of abutting connecting members secured to a corner post, illustrating a corner splice reinforcement.

As discussed further below, connecting member 80 includes a pair of side walls 85 to which exterior sheeting 400 or interior sheeting 300 may be attached. Preferably, the connecting member also includes a pair of small vertical flanges 85*a* extending from the pair of side walls 85 above the top surface 85*b* of the member 80. As best shown in FIG. 22, the pair of small vertical flanges 85*a* span the length of the connecting member 80. Moreover, the corner connecting member 81 may also comprise small vertical flanges 81*b* extending from the side walls 81*a*. Provision of these small flanges 85*a* enable workers to stand on top of the connecting member as they are setting the trusses, for example. The small flanges 85*a* act to stop the sole of the worker's shoe from sliding off the top of the connecting member. Conversely, when these two small flanges 85*a* are not provided, the top surface 85*b* of the connecting member 80 becomes a slipping hazard from moisture resulting from rain, dew, or debris on the soles of the worker's shoes. In addition, as shown in FIG. 29, the connecting member 81 may also include a set of one or more vertical ridges 81*c* extending from the top surface of the connecting member running between, and parallel with, the pair of vertical flanges 81*b*. The presence of these additional ridges 81*c* along the top surface of the connecting member provides an even better foothold for the worker while standing on top of the assembly. It will be appreciated by the skilled artisan that one or more of these ridges 81*c* may also be provided along the top surface of the regular connecting member 80 described above. Finally, while the FIG. 29 shows both vertical ridges 81*b* and 81*c* running the entire length of the member, if desired, the ridges may instead run along only a portion of the top surface of the connecting member, or be broken into linear segments (not shown) as opposed to one continuous line with no breaks, as shown.

Figure 28:
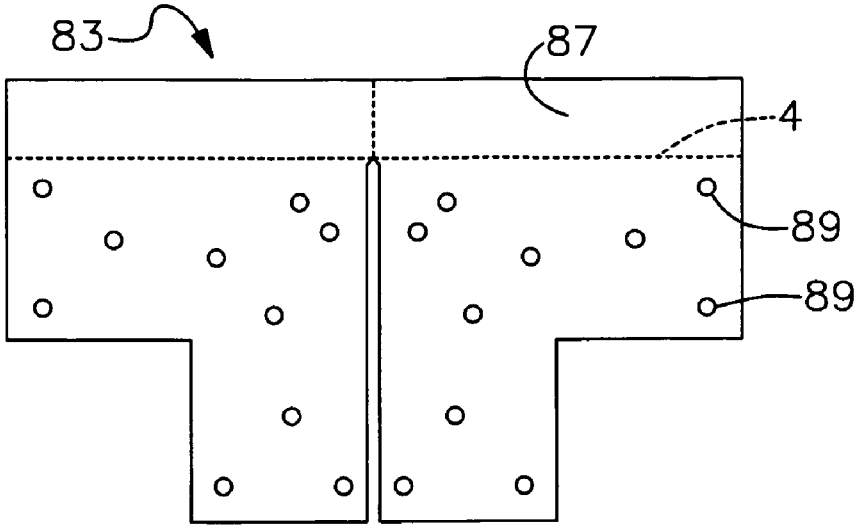
FIG. 28 is a top view of a top corner connecting member, illustrating the cut and fold lines for its fabrication.

The connecting members 80 may be secured to the stud and to one another by any number of conventional means; however, a preferred fastening method is the use of splices 88 that are fastened onto the top surface of adjacent connecting members as shown in FIG. 22, for example. Preferably, the splice 88 is a steel C-channel member similar in configuration to the C-channel connecting member 80 illustrated herein and is secured to the adjacent connecting member 80 just above the stud via a series of screws 93 or nails Other fasteners, including, but not limited to, nails, bolts, pins, clamps, and adhesives, may also be employed to secure the splices to the connecting members. In order to secure the ends of adjacent C-channel connecting members along a corner post, a splice 83 may also be used, as shown in FIGS. 28-29. In order to accommodate the 90-degree angle of the connection, the splice 83 preferably has a top L-shaped configuration as well as an inner channel that engages the underlying ends of the connecting member over the corner post. FIG. 28 illustrates an exemplary method of fabricating the corner splice 83, wherein the top edge 87 is folded down along dotted line 4. The splice 83 may be secured to the C-channel connecting member 81 via fasteners 93, such as screws, through predrilled bores 89 and through the top edge 87 of the splice securing the exterior perimeter of the stud.

Figure 30:
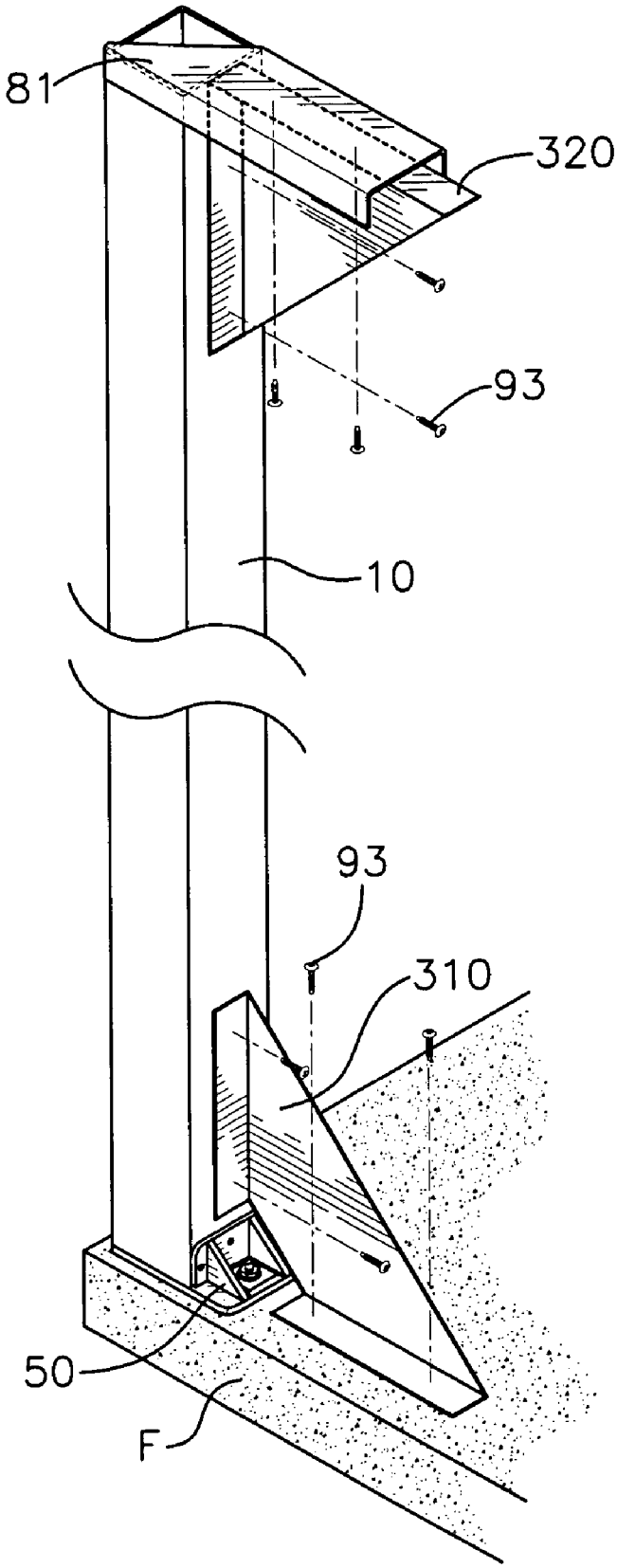
FIG. 30 is a partial perspective view illustrating top and bottom corner braces for creating a shear wall to prevent racking of the corner post to the floor pad and upper connecting member.

For added shear wall stability to the framing assembly, corner braces 310, 320 may be secured to the corner posts as shown in FIGS. 1 and 30. Preferably, a bottom corner brace 310 is secured to the lower end of the corner post and floor pad F, and a top corner brace 320 is secured near the top of the corner post and the C-channel connecting member 81, as shown. The brace 310 on the corner posts and non-corner post studs may include a cut-out in order to accommodate the stud mount, as shown. Moreover, additional bracing 320 may be employed to secure the non-corner post studs (e.g. studs 20, 30, 40, 200), as shown in FIG. 1, for example.

The splices 83, 88 may be formed of a variety of materials typically used in construction; however, in the present invention, these components are preferably formed of a metal or metal alloy, including, but not limited to, steel, stainless steel, aluminum, and the like. In addition, preferred materials for fabricating the corner braces 310, 320 include a variety of metals and metal alloys, including, but not limited to, steel, stainless steel, aluminum, and the like. Both connecting members 80, 81 may be fabricated of a variety of materials; however, in the preferred embodiment these components are preferably made of a fiber reinforced composite. In addition, metals including, but not limited to steel, stainless steel, aluminum, and the like may be used.

In certain aspects of the present invention, horizontal headers may be employed over window openings W and door openings D, as shown, for example, in FIGS. 1, 16-17, 21, 23, and 33. Typically, certain headers 150, 250 of the present invention that are illustrated in the figures are required or recommended in practice to span window openings that are three feet or greater as well as other openings, such as door way openings, that are three feet or greater. As used herein, "door openings" shall mean any opening in a support or non-support wall for an overhang on a lanai, car port, interior portico, and the like. These headers are secured near the top ends of adjacent studs, thereby spanning the opening between these two studs.

Figure 16:
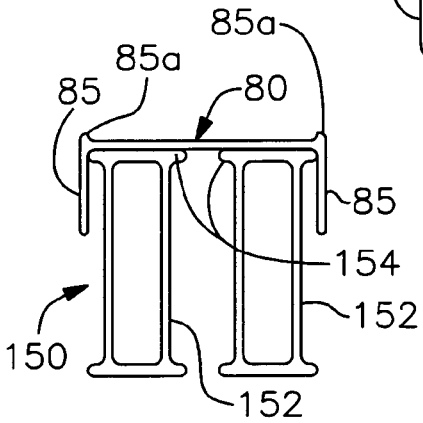
FIG. 16 is a front view of one embodiment of a header of the present invention.
Figure 21:
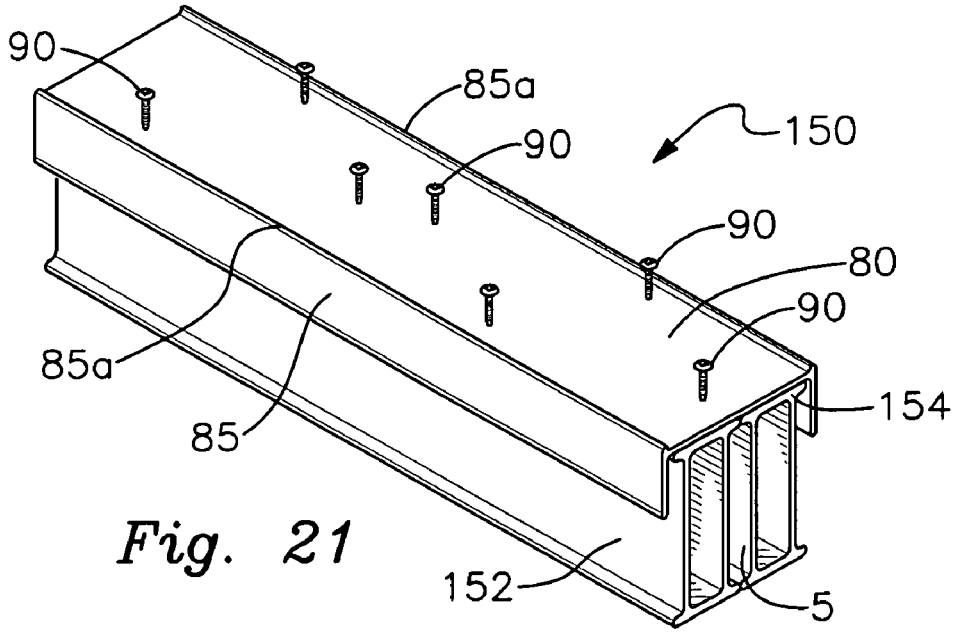
FIG. 21 is a perspective view of the header shown in FIG. 16.

FIGS. 16-17, 21 and 23 illustrate two embodiments of headers that may be employed in the present invention; however, it will be recognized by those of ordinary skill in the art, having the benefit of the teachings of this disclosure and of the prior art, that other types of headers may be employed without departing from the scope and spirit of the present invention. As shown in FIGS. 16 and 21, one header is fabricated by using two elongated members, namely two double I-beams 152 similar to the double-I stud discussed above, or by using two single-I beams (not shown). The two beams 152 are aligned as shown such that adjacent upper flanges 154 are in registration with one another. A C-channel connecting member 80 is then secured to a pair of adjacent flanges via a number of fasteners 90. Preferably, the space 5 between the adjacent double-I beams of the header 150 is about 0.5 inch for most building applications, although it will be apparent to the skilled artisan that other sizes may be employed depending upon the structure. As shown in FIG. 21, the C-channel connecting member 80 has the same length as the inner I-beams members 152, however, as shown in FIGS. 1 and 33, the header 150 may comprise of the inner I-beam members secured to the existing C-channel connecting member 80, 81 of the framing assembly, such that the connecting member 80, 81 component of the header 150 is far longer than the inner I-beam members 152 of this header embodiment. An alternative header embodiment is shown in FIGS. 1, 17, 23, and 33 wherein the header 250 is a single piece having a double-I beam configuration, including upper and lower flanges 254*a*, 254*b* similar to the first header 150 described above. Specifically, the upper and lower flanges 254*a*, 254*b* are secured to opposite ends of a central elongated double-I beam, as shown. Preferred dimensions for the second header embodiment 250 include a length from the top flange 254*a* to the lower flange 254*b* of about 6.5 inches and a width of about 3.75 inches from side wall to side wall 256 of the upper flange 254*a*. The first header embodiment 150 may be similarly dimensioned; however, it will be recognized by the skilled artisan that these dimensions may be modified when desired. Moreover, it will further be recognized by those of ordinary skill in the art that the headers 150, 250 illustrated herein may be used interchangeably, such that the single-piece header 250 may also be installed above a window opening W, and the first header 150 embodiment may also be installed above a door opening D.

Preferably, in order to provide workers a better foot hold, as described above for the connecting members 80, the header 250 may include a pair of small vertical flanges 255, each of the flanges extending from one of the side walls 256 above the top surface 257 of the header. As for the connecting member 80, these small flanges 255 act to stop the sole of the worker's shoe from sliding off the top of the header during assembly. Similarly, the first header 150 described herein may also include a pair of small vertical flanges 85*a* extending from the side walls 85 of the connecting member. Finally, as described above for the connecting members 80, 81, and as illustrated in FIG. 29, for example, header 250 may further include a set of one or more vertical ridges extending from the top surface of the upper flange 254*a* and running between, and parallel with, the pair of small vertical flanges 255. This second set of ridges may also be provided on the connecting member 80 portion of the first header 150. For ease of illustration, however, this second set of ridges is not shown in the figures illustrating the inventive headers 150, 250. As for the connecting members 80, 81, the presence of these additional ridges on the headers as described herein provides an even better foothold for the worker while standing on top of the structural assembly. Finally, as discussed above with respect to connecting member 81, the vertical ridges may run along the entire length of the header or only upon a portion of header or be broken into linear segments along the header.

Figure 23:
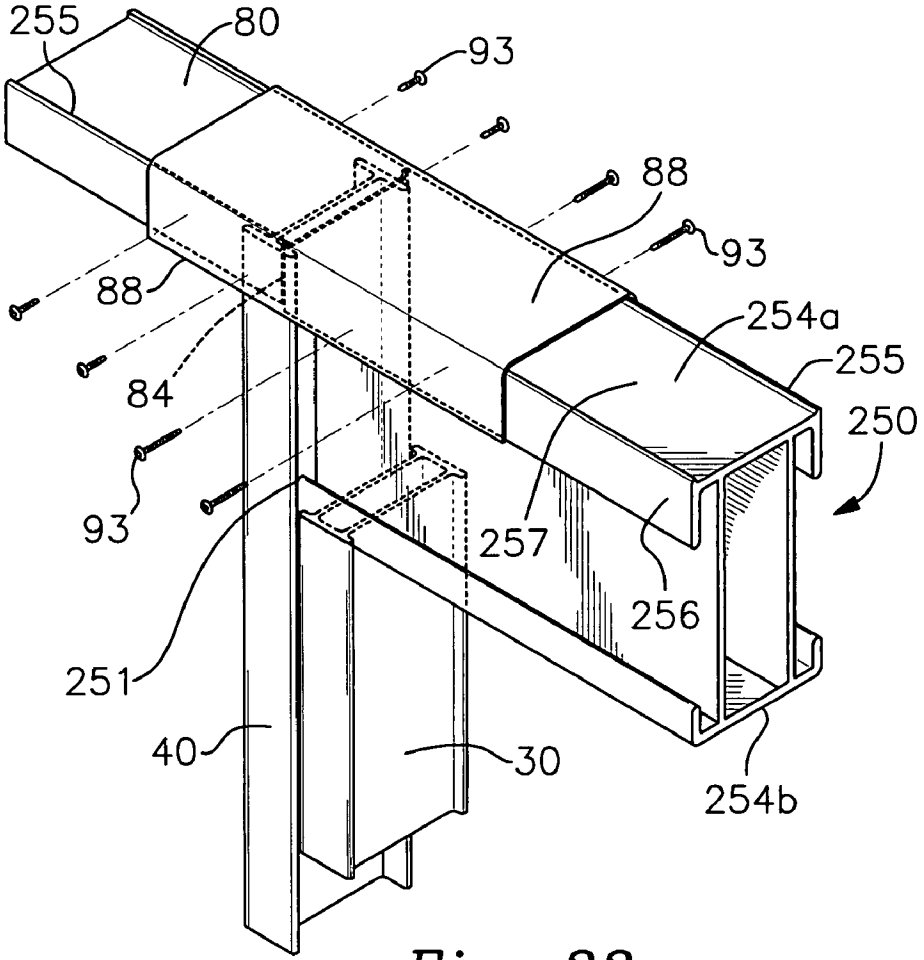
FIG. 23 is a perspective view of the header shown in FIG. 17 and a c-channel connecting member secured to a double-I stud shown in FIG. 14 and a connecting member c-channel supported by a single-I stud shown in FIG. 15.

The door opening D (and larger window openings) are framed on the sides by a pair of vertical studs 30, 40 and on top of the doorway opening, but beneath the connecting members 80, by one of the headers 250 (see FIG. 33). [For ease of illustration, FIGS. 23 and 33 show more clearly the positioning of the second header embodiment 250; however, it will be recognized that the first header 150 design described herein, as well as other headers, may be employed instead.] As shown in FIG. 23, one end 251 of the header 250 is supported on top of an underlying stud 30, preferably the double-I stud 30 shown, and abuts a second stud 40, preferably the single-I design, the latter stud adjacent and flush with the first stud 30, as shown. Preferably, one end 84 of a C-channel connecting member 80 is aligned next to the adjacent end 251 of the header as shown. The connecting member is fastened to the header by a splice 88, as described above and illustrated in FIG. 23. Suitable fasteners 93 for securing the splice to the header and connecting member include, but are not limited to, screws, bolts, nails, pins, adhesives, and the like.

Figure 31:
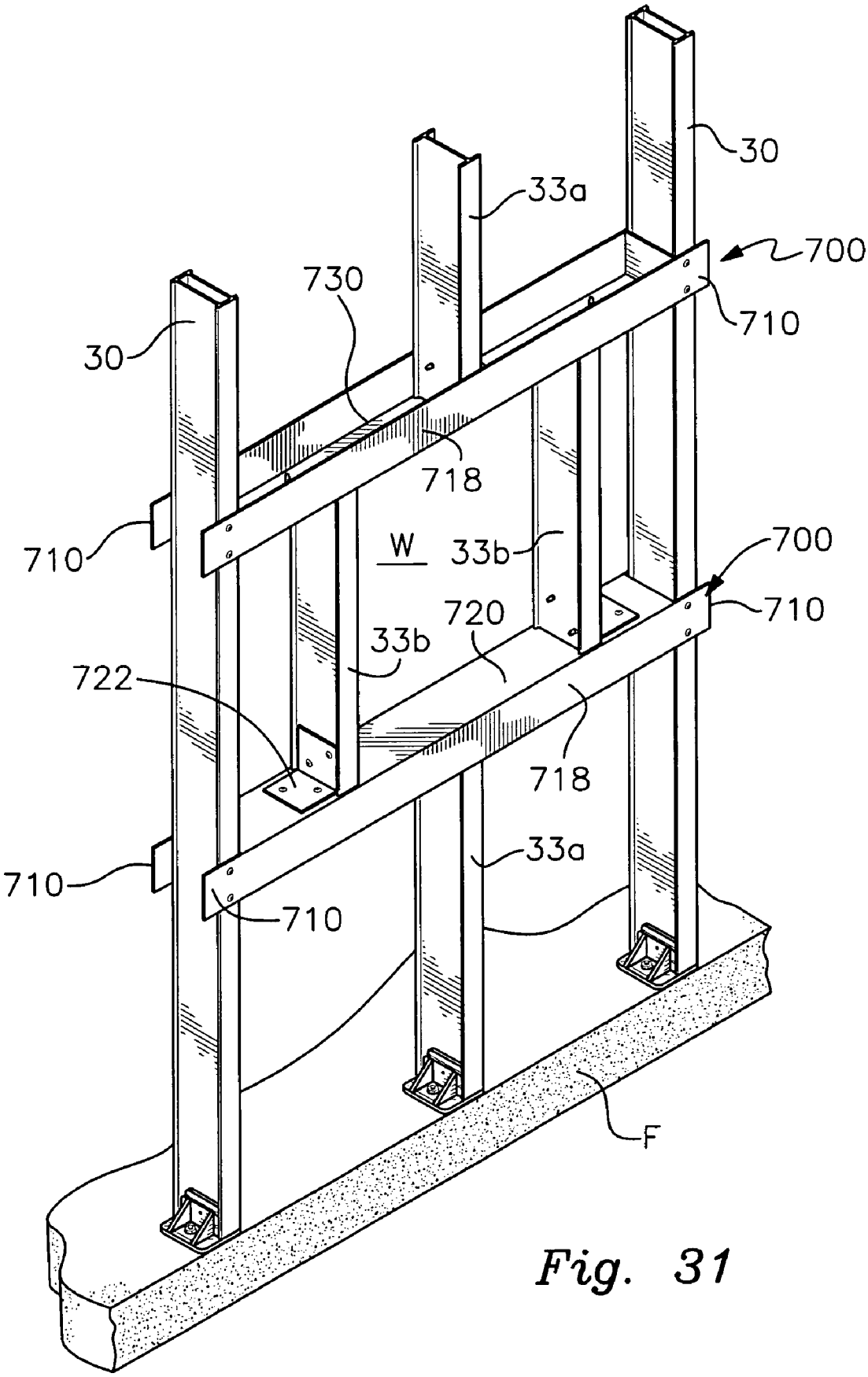
FIG. 31 is a partial view of a window opening of the inventive framing assembly.
Figure 32:
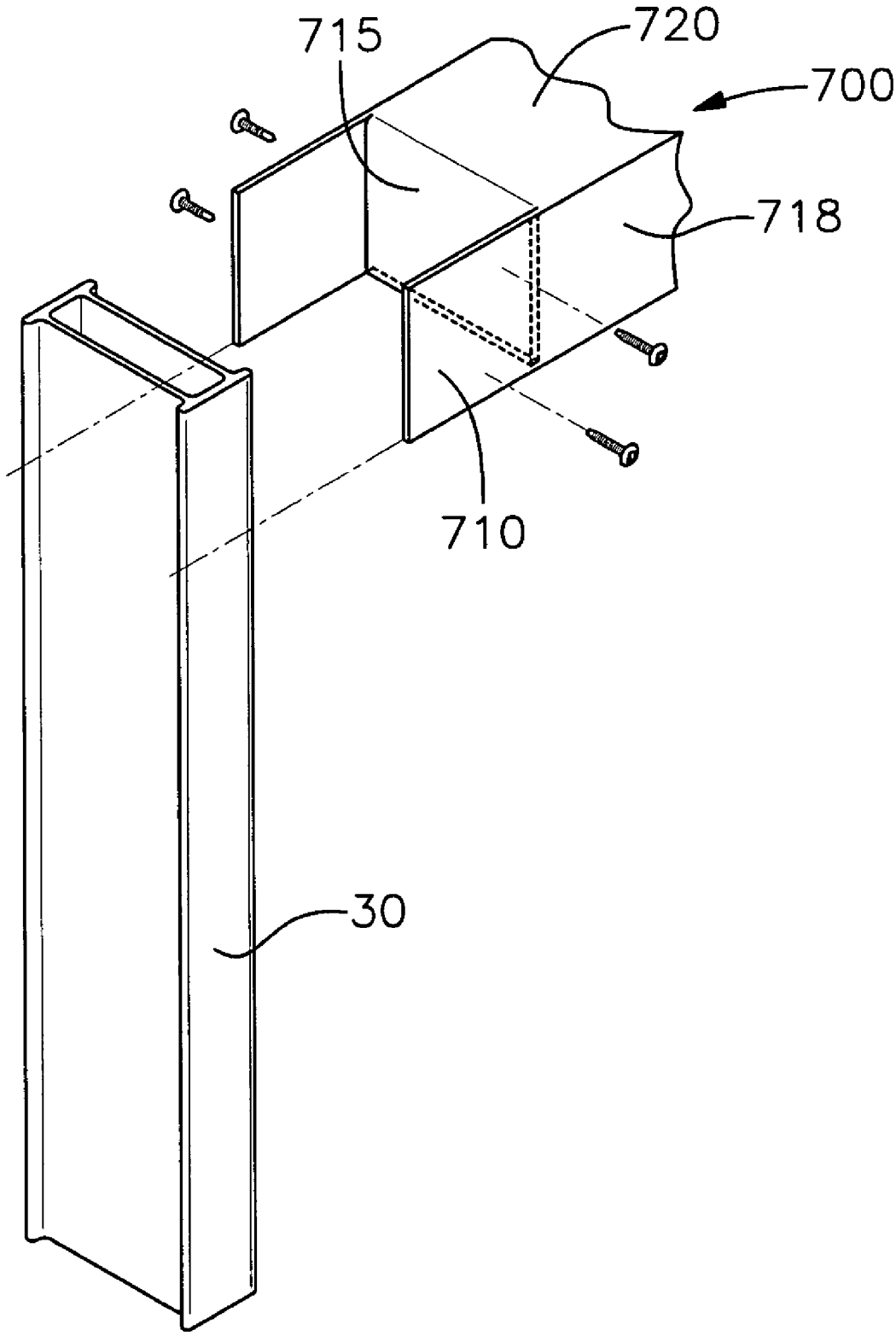
FIG. 32 is an exploded view of one of the modified connecting members of FIG. 31 secured to a single stud of the present invention for creating a window opening.

For window openings W, instead of using the door opening headers 150, 250 thus described, modified C-channel connecting members 700 may be secured to adjacent vertical studs 30, as shown in FIG. 1 and FIGS. 31-33. As better illustrated in FIG. 32, cuts can be made to the C-channel connecting member 80 described thus far to form ears 710 that are integral with and extend from the side walls 718, and an end wall 715 that abuts and engages the stud 30. Two modified C-channel connecting members can be arranged (within one inverted as shown) about two vertical studs 30, as shown in FIG. 31, such that a window (not shown), when installed, is able to rest on two flat surfaces, namely the respective top surfaces 720 of the modified C-channel connecting members 700. Smaller vertical studs, preferably single-I studs 33*a* as shown in FIG. 31, are oriented above and below the window opening, as shown, each secured within the recess 730 of the connecting member 700. Small single-I studs 33*b* are also used to form the sides of smaller window openings, as shown, each secured to an underlying connecting member 700 by an L-shaped angle brace 722. For some window openings, the smaller vertical studs 33*b* may be omitted, such that the window opening W is framed in pat by the structural studs 30, as shown in FIG. 33.

The elongated studs and headers of the present invention may be fabricated of any material (metal and non-metal) commonly known and used in the metal, composite, or construction industries; however, the illustrated designs of the structural components and their assembly are particularly well-suited for fabrication using extruded metals and composite materials, molded composite materials, or pultruded composite materials. The combination of the structural design and use of these lightweight materials provides for a more cost-effective product that is lighter in weight, more precise dimensionally, capable of automated production, and faster to erect than currently applied construction support framing technologies, such as pre-cast lintels or cast in place tie beams, used with concrete block buildings, wood fabricated or manufactured lumber headers used in wood buildings, or steel box beams or steel I beams used in steel buildings. The use of composites in the inventive structural framing assembly in particular is also more ecologically friendly, requires less material, and has superior sustainability when compared with all other structural support framing assemblies.

As used herein, "composite" material shall mean any material that is formed from fiber materials impregnated with a resin, also commonly referred to as "fiber-reinforced plastics" (FRP). The fibers and resins used to form the composite material may be combined in an extrusion process, and therefore referred to herein as an "extruded fiber reinforced composite," or they may be combined in a molding process, and therefore referred to herein as a "molded fiber reinforced composite," or finally, they may be combined in an pultrusion process, and therefore referred herein as a "pultruded composite." Exemplary fiber materials for use in the pultruded composites include, but are not limited to, hemp, kenaf, jute, flax, sisal, acralate, polyethylene, polyester, or spectra organic fibers or fiberglass, aramids (e.g. KEVLAR), basalt, carbon, graphite, boron, and quartz inorganic fibers. Generally, the fiber material may be formed from any long, longitudinally oriented, fiber strands woven into ropes or rovings, or processed into woven cloth mats in 45-degree and 90-degree wrap and weft orientations or other configurations of filaments, such as directionally laid mats, continuously laid mats, and continuously laid and stitched mats. Other exemplary fiber materials include, but are not limited to, silicon carbide, ceramics, stainless steel, and nickel.

The resins may be selected from any number of thermoset or thermoplastic materials. Exemplary thermoplastic materials include, but are not limited to, polyesters, polypropylenes (PP), vinylesters, polycarbonates, nylon, polyvinyl chloride (PVC), and PVC derivatives, polyethylene (PE), high density polyethylene (HDPE), polyphenylene sulfide (PPS), polycarbonate (PBT), acetal, acrylonitrile-butadine-styrene (ABS), polysulfone, polyethersulfone, polyetheramide, polyetheretherkeytone (PEEK), and Teflon. Exemplary thermoset materials include, but are not limited to, phenolics, polyesters, epoxies, and polystyrenes, silicon, vinyl esters, polyesters alkyds, cyanate esters, bismaleimides (BMI), polyimides, melamines, dially phthalate (DAP), urea, furans, silicates and polyurethanes.

The pultrusion, molding, and extrusion processes that may be employed, as well as the amounts and combinations of resins and fiber materials used, depending upon the particular manufacturing process employed (i.e. extrusion versus pultrusion versus molding), are those that are commonly known by those of ordinary skill in the art. Example 1 provides a preferred resin formulation for fabricating the elongated studs described and illustrated herein via pultrusion. Example 2 provides a preferred resin formulation for conventional fiberglass reinforced thermoset plastic molding processes. These formulations in particular provide components having a particularly light weight, high strength, minimum flexibility, high stress resistance, and superior fatigue. It will be further recognized by those of ordinary skill in the art that the types and amounts of resins, fibers, and other materials comprising the composite formulations used to fabricate the inventive studs and other components of the present invention may be modified in order to provide different directional strengths to the components, depending upon the load requirements of the particular framing assembly design.

A typical pultrusion process using, for example, the formulation described in Example 1 comprises first blending the various compounds. The liquid compounds listed in Part B of Example 1 are placed in a stationary mixer, and the solid compounds of Part B are then added and blended for approximately 30 minutes. The resulting mixture is then transferred to the resin tank of a pultrusion machine. For the components listed in Part A of Example 1, the glass fiber rovings are fed from spools through a grid which organizes the rovings to approximate the shape of the structural component (e.g. stud). The glass mat is then added to surround the perimeter of the component. The rovings and glass mat are then passed through the mixture comprising the Part B compounds and become saturated. The resin impregnated glass mat and rovings go through a series of performance dies that organize and pre-form the wetted rovings and mat to the approximate shape and size of the finished structural component. The wetted shape is pulled at three to five feet per minute through a four-foot long steel die that has a continuous heat application of approximately 375 degrees Fahrenheit. The die is open at both ends and has a profile shape similar to any of the profile shapes shown in FIGS. 10-18, for example. An exothermic reaction occurs halfway through the die, thus causing the resin to polymerize, forming a solid mass in which fiberglass under tension has been trapped.

Upon exiting the die, the fully cured structural component is cooled sufficiently (at an appropriate distance) until it can enter the caterpillar or reciprocating pullers without being deformed by the pressures of the pullers or the nine to twelve tons of pull force required to pull the fibers through the resin and die. After passing through the reciprocating pullers, a saw travels at the same speed of the part and cuts the part to predetermined lengths.

A conventional molding process for fabricating structural components using the formulation listed in Example 2 comprises mixing by first adding the powder and fiber compounds of the formulation into a kneading mixer and blending. The liquid compounds of the formulation are then added to the mixer and blended in. The total mixture is blended for approximately 50 minutes and then packed for transport to the injection molding press. Here, the mixture is put into a hopper above a screw injector. The straight screw barrel is heated so that the mixture will flow smoothly and approach its reaction temperature. At 350° F. to 425° F., the mixture is forced into a die that is heated above the point at which spontaneous cross-link curing begins. The structural component is then cured. A typical cycle time for manufacturing a stud mount of the present invention, for example, using this process is about 50 seconds from discharge of one stud mount, through injection, reaction, and discharge of the second stud mount.

It will be recognized again by those of ordinary skill in the art that the foregoing description of conventional pultrusion and extrusion processes may be varied, and that the temperatures and mixing times, for example, may be changed.

The components of the present inventive framing assembly discussed thus far (i.e. elongated studs, stud mounts, headers, and various connecting members) have been described with reference to exterior wall support framing—that is, framing for securing external wall sheets on one side and interior wall sheets on the other side to support the downward loads from the walls and roof above, or the uplift loads from hurricanes and tornadoes, or the racking loads from earthquakes. To define interior rooms within the framing structure, conventional studs, such as 2×4 wood studs 302 or steel C-channel studs 304 shown in FIG. 2 may be employed. These conventional studs are secured to the floor pad by C-channels or sill plates conventional fasteners, such as concrete nails, screws, and the like. Alternatively, the inventive studs of the present invention may be employed for the interior walls.

Figure 19:
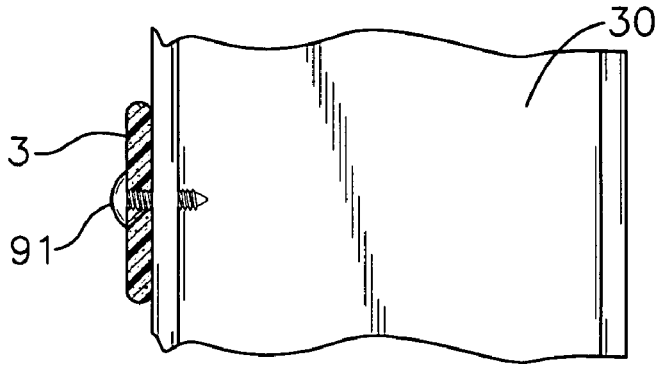
FIG. 19 is a side, cross section view of the inventive nailing attachment strip secured to a stud.
Figure 20:
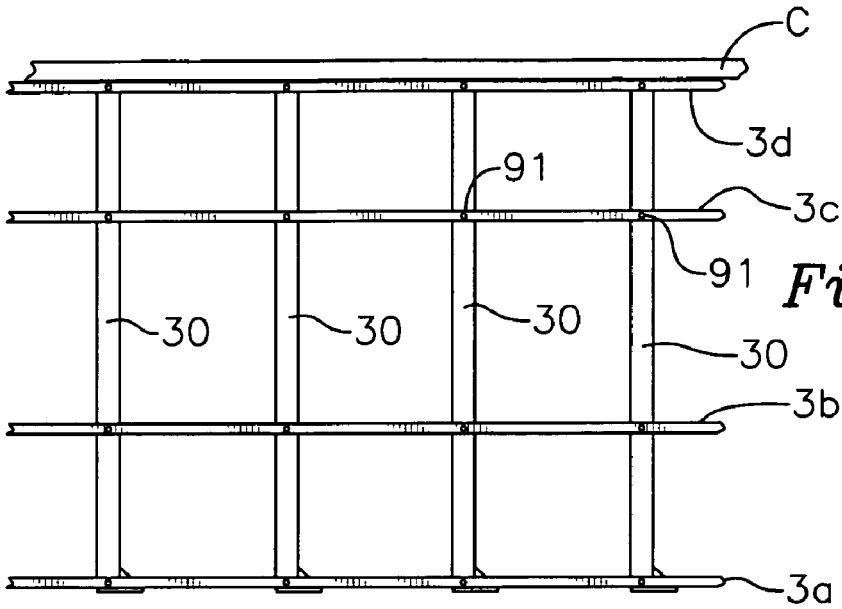
FIG. 20 is a front view showing a series of attachment strips, as illustrated in FIG. 19, secured to adjacent vertical studs of a framing assembly.

When composites are used for manufacturing the inventive studs, preferably thermoset resins are employed. Such materials, however, are difficult to penetrate with nails (e.g. pin nails and finishing nails used to secure moldings to interior walls) and screws (e.g. deck screws used to attach cabinets, for example, to interior walls) without splitting the fibers of the composite stud. This can be a problem on the interior of the support framing assembly when it is desired to secure a chair rail, for example, to an interior wall that is attached to the inventive exterior support framing. Instead of there being a wood stud to which the chair rail can be nailed, there is the hard composite stud as described above, the latter of which is not readily penetrable by conventional screws (non-self drilling) or nails, and as mentioned above, will often split if nails or screws are used to secure these interior components (e.g. chair rail, molding, cabinets, etc.) to the stud. Consequently, in order to solve this problem, certain aspects of the present invention include the employment of a horizontal attachment strip 3 that is secured to the framing assembly, as shown in FIGS. 19-20. The attachment strip is formed of a thermoplastic resin or other material that is readily penetrable by a nail or screw, for example. Preferably, the strip is about 1.5 inches in width, although the strip may be of any number of widths and thicknesses. Specifically, this strip 3 is secured to two or more adjacent studs 30 using screws 91, as shown in FIGS. 19-20. Typically, more than one strip 3*a*-3*d* is employed at different levels along adjacent studs 30 in order to serve as an attachment means for different components. For example, one strip 3*a* may be secured near the floor pad at one level for attaching base molding, another strip 3*b* is attached at a higher level for securing a chair rail, a third strip 3*c* is attached at an even higher level for securing the back of kitchen cabinets, for example, and a fourth strip 3*d* is attached at a top level near the ceiling C (see FIG. 34) for securing crown molding thereto. It will be readily apparent to the skilled artisan, however, that a fewer or greater number of strips 3 may be employed and/or spaced at different intervals along the studs as desired. The dry wall or other interior wall sheet 300 is then secured to the surface of the stud via screws 91, for example, thereby covering the attachment strip 3. Alternatively wood spacers can be inserted horizontally between the studs to achieve the same purpose (not shown).

Figure 4:
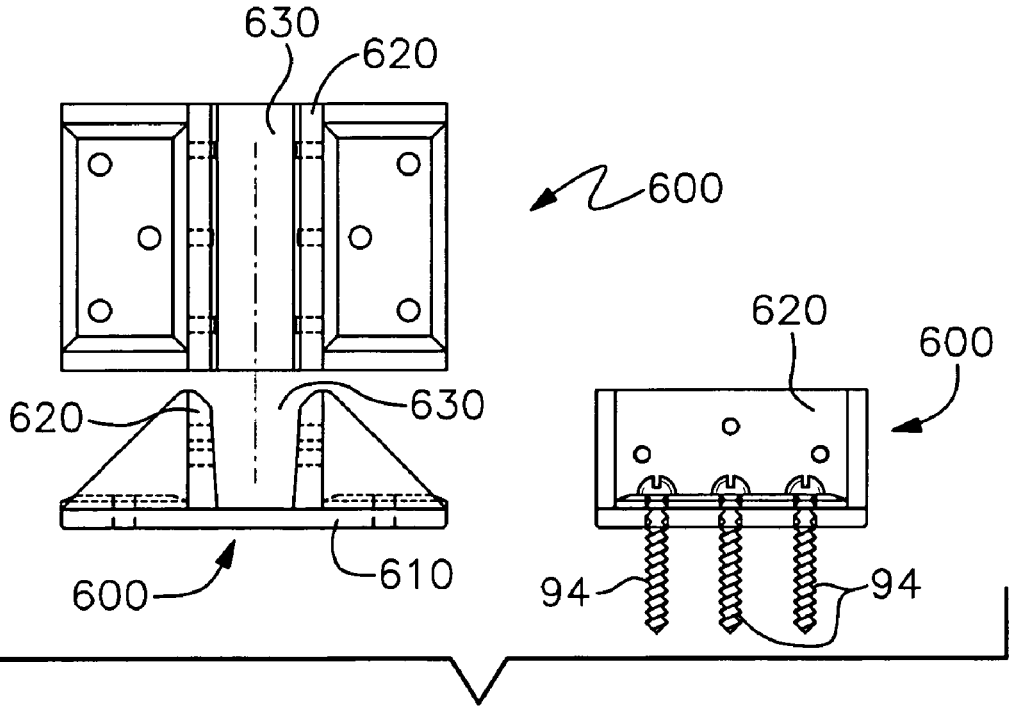
FIG. 4 illustrates top, front, and side views of the inventive truss mount of the present invention.

In order to secure roof trusses to the structural exterior framing thus described and illustrated herein, a set of truss mounts 600 may be employed. As shown more clearly in FIGS. 1, 4, 33, and 34, each truss mount 600 is preferably positioned every two feet along the top of a framing assembly 1 and secured to the top of the connecting member 80 using screws or bolts 94 (see FIG. 4). As shown in FIG. 4, the truss mount 600 comprises a base 610 and two parallel plates 620 which are integral with, and extend substantially perpendicularly from, the base 610 of the truss mount. The recess 630 defined between the two parallel plates 620 is sufficiently large to engage an elongated section of the truss T or rafter (See FIG. 34). The trusses or rafters used in the present invention may be any standard wood or metal truss or rafter conventionally used in the construction industry, although trusses formed of a composite material may also be employed. Once the truss T or rafter is secured within the truss mount with a fastener from one or both sides, a metal strap 2*a* is secured to the stud and run over the truss or rafter to hold it down for added strength and stability for construction against uplift and racking forces in potential hurricane, tornado, and earthquake zones (see FIG. 34).

Figure 18:
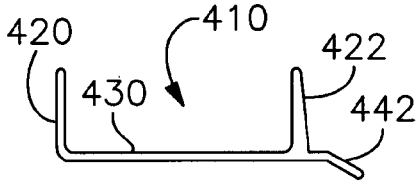
FIG. 18 is a cross-section or end view of the inventive sill plate of the present invention.
Figure 17:
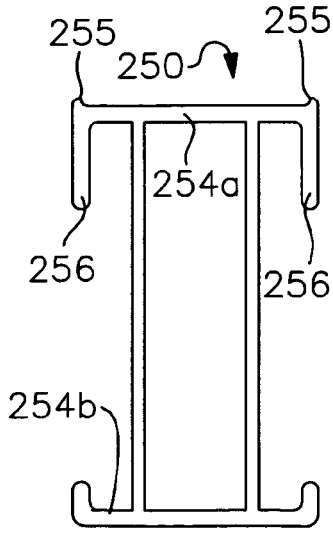
FIG. 17 is a front view of a second embodiment of a header of the present invention.
Figure 24:
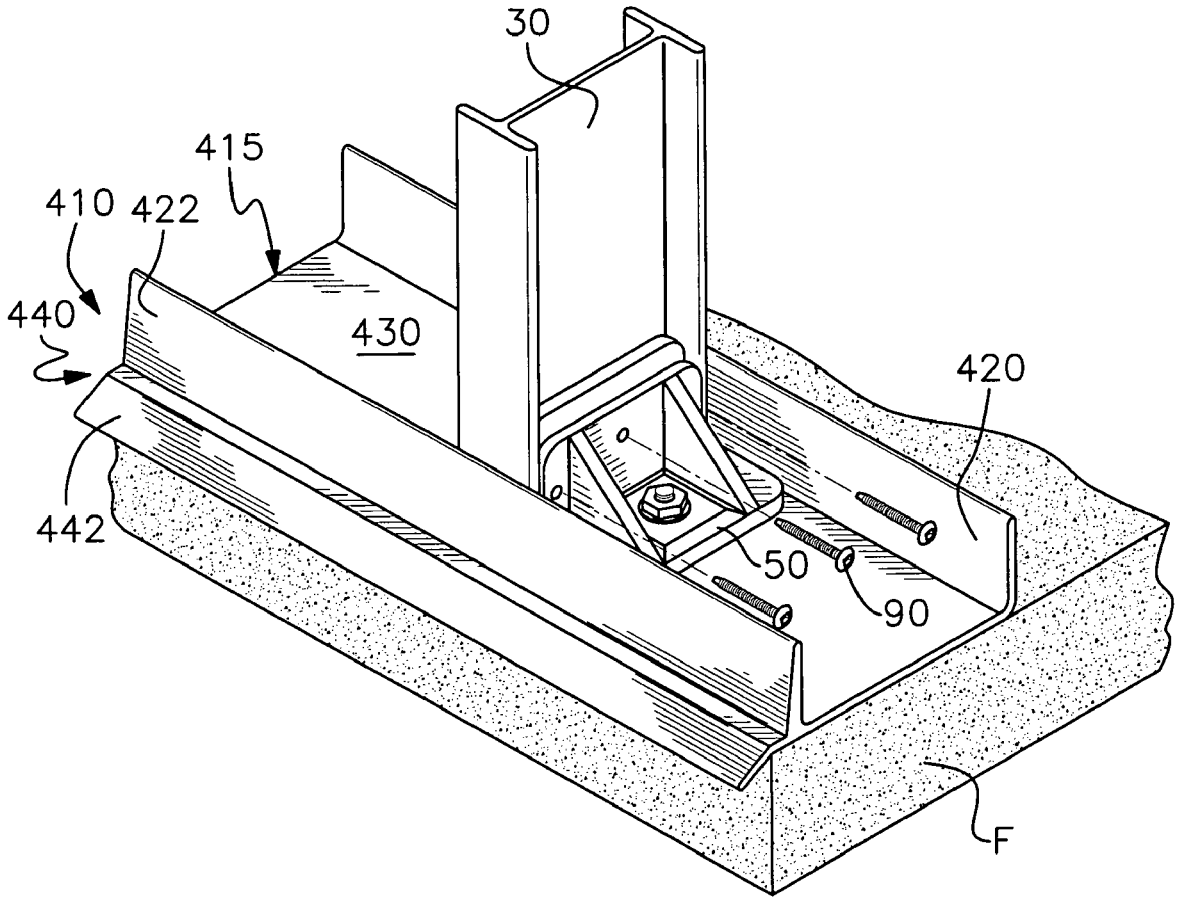
FIG. 24 is a side view of the sill plate of FIG. 18 with a stud mount secured therein.

Additional aspects of the present invention include the use of one or more sill plates 410 secured to the floor pad F, as shown in FIGS. 18, 24, and 34. Each sill plate 410 includes a recess 415 sufficiently large to house one or more stud mounts. Thus, the stud mount rests upon the base 430 of the sill plate (see FIG. 24). In certain aspects of the present invention, the sill plates are formed of a thermoplastic resin or composite like that used for the attachment strip 3 described above, and thus function as another means to which nails or screws, for example, can be engaged when installing an interior wall sheet 300 or base molding, for example. In a preferred embodiment, the sill plate 410 includes an interior side wall 420 and an exterior side wall 422. Projecting from the outer surface of the exterior side wall 422 is a shield 440 that has a portion 442 angled downward over the edge of the underlying floor pad F. This shield, in combination with the exterior wall 422 of the sill plate, functions as a drain for rainwater run-off as well as a protective barrier against subterranean termites and similar pests. While the inventive sill plates are shown in several of the figures, it will be recognized by those of ordinary skill in the art that the sill plate is an optional feature of the inventive framing assembly and may be used without stud mounts in zones where hurricane or tornado uplift forces or seismic racking forces are not encountered. Likewise, it will further be recognized that the sill plates described and illustrated herein may be incorporated in other framing assemblies and made from thermoset resins.

As discussed throughout this description, the dimensions and configurations of the various components of the inventive framing assembly may be modified depending upon the desired application. Preferred dimensions will often be those required according to certain state or country building codes and/or simply accepted standards in the building industry.

Example 1

The following pultrusion mixture was made for fabricating the studs of the present invention, using conventional pultrusion process.

| | Weight % | Item |
|---|---|---|
| A. | 49 | fiberglass roving |
| | 1 | fiberglass continuous strand mat |
| B. | 18 | polyester resin |
| | 6 | vinyl ester fire retardant resin |
| | 4 | PVA (polyvinyl acetate) anti shrink angent |
| | 1 | release agent |
| | 1.5 | Styrene |
| | 0.5 | White Pigment |
| | 0.015 | UV Stabilizer |
| | 18.36 | Calcium Carbonate |
| | 0.5 | high initiation temp Catalyst |
| | 0.125 | low initiation temp Catalyst |
| | 100.000 | |

Example 2

The following mixture was made for fabricating the truss mounts and stud mounts of the present invention, using conventional molding process.

| Weight % | Item |
|---|---|
| 30 | glass fiber |
| 10.5 | polyester resin |
| 40.7 | calcium carbonate |
| 13.4 | styrene monomer |
| 3.45 | Polyvinyl acetate |
| 0.70 | Magnesium oxide |
| 1.0 | Zinc Stearate |
| 0.25 | t-Butyl perbenzoate |
| 100.00 | |

I claim:

1. A structural support framing assembly comprising:

a) a plurality of stud mounts, each of said stud mounts having a base secured to a floor pad;

b) a plurality of elongated studs, each of said elongated studs having a top end and a bottom end, said bottom end having one or more edges engaged within one or two of said stud mounts;

c) each of said stud mounts further having plates aligned parallel to one another, said plates integral with and perpendicular to said base, wherein adjacent plates form an elongated slot therebetween to engage only one of said bottom edges of said stud within said slot;

d) each of said plurality of stud mounts secured to only one of said plurality of studs, wherein one edge of a single side wall or web of said studs is engaged within said elongated slot of one of said stud mounts;

e) each of said plurality of stud mounts further having one or more bracing plates integral with said base and an outer most one of said plates, to provide added support to said stud mount;

f) each of said plurality of studs, in combination with said stud mounts, are positioned parallel to one another and perpendicular to said floor pad to define, in combination with one another, an interior portion of said framing assembly; and g) a plurality of fasteners for securing said studs to said stud mounts, at least one of said fasteners engaging a side wall or web of one of said studs to one of said adjacent plates along any point along said stud side wall or web, thereby allowing for height adjustment of said stud within said stud mount to accommodate any un-level areas of said floor pad.

2. The framing assembly of claim 1, wherein said studs are formed of a composite material.

3. The framing assembly of claim 1, each of said plurality of studs further comprised of:

a) a first set of corner posts, wherein each of said corner posts has a hollow outer body defining a inner longitudinal channel, a portion of said outer body further including an indentation sufficiently large for receiving an outer edge of an interior wall sheet, said indentation oriented toward said interior portion of said framing assembly; and b) a second set of studs positioned between two of said corner posts.

4. The framing assembly of claim 1, each of said plurality of studs further comprised of:

a) a first set of corner posts; end b) a second set of studs positioned between two of said corner posts; and wherein each of said studs has an outer body forming a longitudinal channel and a substantially rectangular transverse cross-section.

5. The framing assembly of claim 4, wherein at least one of said corner posts has an inner longitudinal channel communicating therethrough, and wherein said channel of at least one of said second set of studs houses at least one electrical or electronic transmission wire running therethrough.

6. The framing assembly of claim 3, wherein at least one of said corner posts and one of said second set of studs are formed of a composite material.

7. The framing assembly of claim 1, wherein at least one of said elongated studs has a substantially I-shaped transverse cross-section comprising two exterior flanges secured to a single interior web oriented perpendicular to said flanges, said interior web further comprising said bottom edge of said elongated stud such that said bottom edge of said elongated stud is engaged within one of said slots of said stud mount.

8. The framing assembly of claim 1, including at least two horizontal C-channel connecting members secured to adjacent studs, each of said connecting members having a top surface integral with a pair of side walls, the combination of which defines an inner channel, wherein each of said two connecting members are aligned in registration with one another over one of said adjacent studs, the top end of each of said adjacent studs engaged within said inner channel, and wherein each of said connecting members includes at least two vertical flanges, wherein one of said flanges extends from one of said side walls above said top surface of said connecting member, to thereby provide a foothold for workers standing upon said connecting member during construction.

9. The framing assembly of claim 8, further including a truss mount for supporting a roof truss or rafter, said truss mount having a base secured onto said connecting member and positioned in registration with the top end of one of said second set of studs, said truss mount further having a pair of parallel plates extending from, and perpendicular to, said miss mount base to define a recess therebetween, said recess configured to engage a portion of said roof truss or rafter.

10. The framing assembly of claim 1, further including at least one elongated horizontal header, said header secured near the top end of adjacent studs and spanning a door opening or window opening located between said adjacent studs.

11. The framing assembly of claim 10, wherein said header has a double I-beam transverse cross-section comprising upper and lower flanges secured to one another by a central elongated double I-beam member.

12. The framing assembly of claim 10, wherein said header comprises two adjacent elongated members, each of said elongated members having a double-I beam transverse cross section configuration and an upper flange, said adjacent elongated header members further secured to one another by a C-channel connecting member secured to the upper flanges of said two adjacent elongated header members, said connecting member having two side walls and a pair of small vertical flanges integral with and extending from one of said side walls of said connecting member, to thereby provide a foothold for workers standing upon said header during construction.

13. The framing assembly of claim 1, including a connecting member spanning a window opening, said connecting member comprising an elongated C-channel having two side walls terminating into opposing ends, each of said opposing ends having a pair of ears extending therefrom and configured to engage one of said adjacent studs.

14. The framing assembly of claim 1, further including one or more attachment strips secured to adjacent studs, each of said attachment strip formed of a composite material suitable for penetration by a fastener for engagement therein.

15. The framing assembly of claim 14, wherein said attachment strip is formed of a thermoplastic composite material and at least one of said studs arc formed of a composite material.

16. A stud mount suitable for securing structural studs to a floor pad, said stud mount comprising:

a) a base configured for attachment to a floor pad;

b) a set of plates integral with and perpendicular to said base, where adjacent said plates are aligned parallel to one another, thereby forming an elongated slot therebetween for engagement of an edge of a bottom end or top end of a structural stud therein;

c) at least one bracing plate integral with said base and an outer most one of said plates;

d) at least one first fastener for securing a portion of said bottom end or top end of said structural stud to said stud mount; and e) at least one second fastener for securing said base to a floor pad.

17. The stud mount of claim 16, wherein each of said plates of said stud mount contains one or more bores through which one of said first fasteners is engaged.

18. The stud mount of claim 16, wherein said base contains at least one bore through which one of said second fasteners is engaged to secure said stud mount to said floor pad.

19. The stud mount of claim 16, wherein said stud mount includes three or more parallel plates, wherein adjacent said plates define a slot therebetween, said slot configured to engage one of said bottom or top edges of said stud.

20. The stud mount of claim 16, wherein said stud mount includes four parallel plates, wherein adjacent said plates define a slot therebetween, said slot configured to engage one of said bottom or top edges of said stud.

21. A structural support framing assembly comprising:

a) a plurality of stud mounts, each of said stud mounts having a base secured to a floor pad;

b) a plurality of elongated studs, each of said elongated studs having a top end and a bottom end, said bottom end having one or more edges engaged within one or two of said stud mounts;

c) each of said stud mounts further having three or mare parallel plates integral with and perpendicular to said base, with adjacent said plates defining a slot therebetween for engaging one of said bottom edges of said stud within said slot;

d) each of said plurality of stud mounts secured to only one of said plurality of studs, wherein one edge of one of said studs is engaged within said elongated slot of one of said stud mounts;

e) each of said plurality of studs, in combination with said stud mounts, are positioned parallel to one another and perpendicular to said floor pad to define, in combination with one another, an interior portion of said framing assembly; and f) a plurality of fasteners for securing said studs to said stud mounts, at least one of said fasteners engaging one of said studs to one of said adjacent plates along any point along said stud, thereby allowing for height adjustment of said stud within said stud mount to accommodate any un-level areas of said floor pad.

22. The framing assembly of claim 21, wherein said stud mount includes four parallel plates, with adjacent said plates defining a slot therebetween for engaging one of said bottom stud edges.

23. The framing assembly of claim 21, wherein at least one of said second set of studs has a substantially double-I shaped transverse cross-section, two interior webs, and two exterior flanges perpendicular to said interior webs to define an inner longitudinal channel, each of said flanges suitable for engaging a wall sheet said interior webs further comprising two of said bottom edges, each of said bottom edges of said double-I stud engaged within one of said slots of said stud mount.

24. The framing assembly of claim 23, wherein at least one of said corner posts has an inner longitudinal channel communicating therethrough, and wherein said channel of at least one of said second set of studs houses at least one electrical transmission wire running therethrough.

25. A structural support framing assembly comprising:

a) a plurality of stud mounts, each of said stud mounts having a base secured to a floor pad;

b) a plurality of elongated studs, each of said elongated studs having a top end and a bottom end, said bottom end having one or more edges engaged within one or two of said stud mounts;

c) each of said stud mounts further having plates aligned parallel to one another, said plates integral with and perpendicular to said base, wherein adjacent plates form an elongated slot therebetween to engage only one of said bottom edges of said stud within said slot;

d) each of said plurality of stud mounts secured to only one of said plurality of studs, wherein one edge of one of said studs is engaged within said elongated slot of one of said stud mounts;

e) each of said plurality of studs, in combination with said stud mounts, are positioned parallel to one another and perpendicular to said floor pad to define, in combination with one another, an interior portion of said framing assembly;

f) a plurality of fasteners for securing said studs to said stud mounts, at least one of said fasteners engaging one of said studs to one of said adjacent plates along any point along said stud, thereby allowing for height adjustment of said stud within said stud mount to accommodate any un-level areas of said floor pad;

g) at least one elongated horizontal header, said header secured near the top end of the adjacent studs and spanning a door opening or window opening located between said adjacent studs, said header comprising a double I-beam transverse cross-section comprising upper and lower flanges secured to one another by a central elongated double I-beam member.

26. A structural support framing assembly comprising:

a) a plurality of stud mounts, each of said stud mounts having a base secured to a floor pad;

b) a plurality of elongated studs, each of said elongated studs having a top end and a bottom end, said bottom end having one or more edges engaged within one or two of said stud mounts;

c) each of said stud mounts further having plates aligned parallel to one another, said plates integral with and perpendicular to said base, wherein adjacent plates form an elongated slot therebetween to engage only one of said bottom edges of said stud within said slot;

d) each of said plurality of stud mounts secured to only one of said plurality of studs, wherein one edge of one of said studs is engaged within said elongated slot of one of said stud mounts;

e) each of said plurality of studs, in combination with said stud mounts, are positioned parallel to one another and perpendicular to said floor pad to define, in combination with one another, an interior portion of said framing assembly;

f) a plurality of fasteners for securing said studs to said stud mounts, at least one of said fasteners engaging one of said studs to one of said adjacent plates along any point along said stud, thereby allowing for height adjustment of said stud within said stud mount to accommodate any un-level areas of said floor pad;

g) at least one elongated horizontal header, said header secured near the top end of the adjacent studs and spanning a door opening or window opening located between said adjacent studs, said header comprising two adjacent elongated members, each of said elongated members having a double-I beam transverse cross section configuration and an upper flange, said adjacent elongated header members further secured to one another by a C-channel connecting member secured to the upper flanges of said two adjacent elongated header members, said connecting member having two side walls and a pair of small vertical flanges extending from one of said side walls of said connecting member, to thereby provide a foothold for workers standing upon said header during construction.

* * * * *